US010683703B2

(12) United States Patent
Faircloth et al.

(10) Patent No.: US 10,683,703 B2
(45) **Date of Patent: *Jun. 16, 2020**

(54) HIGH POWER LASER PERFORATING AND LASER FRACTURING TOOLS AND METHODS OF USE

(71) Applicant: Foro Energy, Inc., Houston, TX (US)

(72) Inventors: Brian O. Faircloth, Evergreen, CO (US); Mark S. Zediker, Castle Rock, CO (US); Daryl L. Grubb, Houston, TX (US); Sam N. Schroit, Littleton, CO (US); Ronald A. De Witt, Katy, TX (US); Sharath K. Kolachalam, Highlands Ranch, CO (US); Paul D. Deutch, Houston, TX (US); Eugene J. Linyaev, Magnolia, TX (US)

(73) Assignee: Foro Energy, Inc., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/656,976

(22) Filed: Jul. 21, 2017

(65) Prior Publication Data

US 2017/0321486 A1 Nov. 9, 2017

Related U.S. Application Data

(63) Continuation of application No. 13/782,869, filed on Mar. 1, 2013, now Pat. No. 9,719,302, which is a continuation-in-part of application No. 13/222,931, filed on Aug. 31, 2011, now abandoned, said application No. 13/782,869 is a continuation-in-part of application No. 12/543,986, filed on Aug. 19, 2009, now Pat. No. 8,826,973.

(Continued)

(51) Int. Cl.

| | |
|---|---|
| ***E21B 7/15*** | (2006.01) |
| ***E21B 49/00*** | (2006.01) |
| ***E21B 43/26*** | (2006.01) |
| *E21B 43/16* | (2006.01) |

(52) U.S. Cl.

CPC ..... *E21B 7/15* (2013.01); *E21B 43/26* (2013.01); *E21B 43/162* (2013.01); *E21B 49/00* (2013.01)

(58) Field of Classification Search

CPC . E21B 7/15; E21B 49/00; E21B 43/26; E21B 43/162; B23K 26/0006; B23K 26/08; B23K 26/38

See application file for complete search history.

(56) References Cited

U.S. PATENT DOCUMENTS 3,788,703 A * 1/1974 Thorpe ..... E21C 37/16 175/16
6,880,646 B2 * 4/2005 Batarseh ..... E21B 43/11 166/222

(Continued)

*Primary Examiner* — Kenneth L Thompson
(74) *Attorney, Agent, or Firm* — Glen P. Belvis; Belvis Law, LLC.

(57) ABSTRACT

There are provided high power laser perforating tools and methods of delivering laser energy patterns that enhance the flow of energy sources, such as hydrocarbons, from a formation into a production tubing or collection system. These tools and methods precisely deliver predetermined laser beam energy patterns, to provide for custom geometries in a formation. The patterns and geometries are tailored and customized to the particular geological and structural features of a formation and reservoir.

11 Claims, 29 Drawing Sheets

Related U.S. Application Data

(60) Provisional application No. 61/605,429, filed on Mar. 1, 2012, provisional application No. 61/727,096, filed on Nov. 15, 2012, provisional application No. 61/378,910, filed on Aug. 31, 2010, provisional application No. 61/090,384, filed on Aug. 20, 2008.

(56) References Cited

U.S. PATENT DOCUMENTS

| | | | | |
|---|---|---|---|---|
| 7,490,664 | B2 * | 2/2009 | Skinner | E21B 7/15<br>166/250.16 |
| 9,664,012 | B2 * | 5/2017 | Deutch | E21B 29/00 |
| 9,719,302 | B2 * | 8/2017 | Linyaev | E21B 7/15 |
| 10,053,967 | B2 * | 8/2018 | Deutch | E21B 43/11 |
| 2010/0044102 | A1 * | 2/2010 | Rinzler | E21B 7/14<br>175/15 |
| 2018/0045024 | A1 * | 2/2018 | Deutch | E21B 29/00 |

* cited by examiner

HIGH POWER LASER PERFORATING AND LASER FRACTURING TOOLS AND METHODS OF USE

This application is a continuation of Ser. No. 13/782,869 filed Mar. 1, 2013, which: (i) claims, under 35 U.S.C. § 119(e)(1), the benefit of the filing date of Mar. 1, 2012 of provisional application Ser. No. 61/605,429; (ii) claims, under 35 U.S.C. § 119(e)(1), the benefit of the filing date of Nov. 15, 2012 of provisional application Ser. No. 61/727,096; (iii) is a continuation-in-part of U.S. patent application Ser. No. 13/222,931, which claims, under 35 U.S.C. § 119(e)(1), the benefit of the filing date of Aug. 31, 2010 of provisional application Ser. No. 61/378,910; and, (iv) is a continuation-in-part of Ser. No. 12/543,986, which claims, under 35 U.S.C. § 119(e)(1), the benefit of the filing date of Aug. 20, 2008 of provisional application Ser. No. 61/090,384, the entire disclosures of each of which are incorporated herein by reference.

BACKGROUND OF THE INVENTION

Field of the Invention

The present inventions relate to high power laser tools for perforating, fracturing, and opening, increasing and enhancing the flow of energy sources, such as hydrocarbons and geothermal, from a formation into a production tubing or collection system. In addition to improved performance and safety over conventional explosive based perforating guns, the present inventions provide for the precise and predetermined placement of laser beam energy, e.g., custom geometries, in precise and predetermined energy distribution patterns. These patterns can be tailored and customized to the particular geological and structural features of a formation and pay zone. Unlike explosive perforating tools, the laser beam and laser perforating process can be controlled or operated in a manner that maintains and enhances the porosity, openness and structure of the inner surface of the perforation.

As used herein, unless specified otherwise "high power laser energy" means a laser beam having at least about 1 kW (kilowatt) of power. As used herein, unless specified otherwise "great distances" means at least about 500 m (meter). As used herein, unless specified otherwise, the term "substantial loss of power," "substantial power loss" and similar such phrases, mean a loss of power of more than about 3.0 dB/km (decibel/kilometer) for a selected wavelength. As used herein the term "substantial power transmission" means at least about 50% transmittance.

As used herein, unless specified otherwise, "optical connector", "fiber optics connector", "connector" and similar terms should be given their broadest possible meanings and include any component from which a laser beam is or can be propagated, any component into which a laser beam can be propagated, and any component that propagates, receives or both a laser beam in relation to, e.g., free space, (which would include a vacuum, a gas, a liquid, a foam and other non-optical component materials), an optical component, a wave guide, a fiber, and combinations of the forgoing.

As used herein, unless specified otherwise, the term "earth" should be given its broadest possible meaning, and includes, the ground, all natural materials, such as rocks, and artificial materials, such as concrete, that are or may be found in the ground, including without limitation rock layer formations, such as, granite, basalt, sandstone, dolomite, sand, salt, limestone, rhyolite, quartzite and shale rock.

As used herein, unless specified otherwise, the term "borehole" should be given it broadest possible meaning and includes any opening that is created in a material, a work piece, a surface, the earth, a structure (e.g., building, protected military installation, nuclear plant, offshore platform, or ship), or in a structure in the ground, (e.g., foundation, roadway, airstrip, cave or subterranean structure) that is substantially longer than it is wide, such as a well, a well bore, a well hole, a micro hole, slimhole and other terms commonly used or known in the arts to define these types of narrow long passages. Wells would further include exploratory, production, abandoned, reentered, reworked, and injection wells, and cased and uncased or open holes. Although boreholes are generally oriented substantially vertically, they may also be oriented on an angle from vertical, to and including horizontal. Thus, using a vertical line, based upon a level as a reference point, a borehole can have orientations ranging from 0° i.e., vertical, to 90°, i.e., horizontal and greater than 90° e.g., such as a heel and toe, and combinations of these such as for example "U" and "Y" shapes. Boreholes may further have segments or sections that have different orientations, they may have straight sections and arcuate sections and combinations thereof; and for example may be of the shapes commonly found when directional drilling is employed. Thus, as used herein unless expressly provided otherwise, the "bottom" of a borehole, the "bottom surface" of the borehole and similar terms refer to the end of the borehole, i.e., that portion of the borehole furthest along the path of the borehole from the borehole's opening, the surface of the earth, or the borehole's beginning. The terms "side" and "wall" of a borehole should to be given their broadest possible meaning and include the longitudinal surfaces of the borehole, whether or not casing or a liner is present, as such, these terms would include the sides of an open borehole or the sides of the casing that has been positioned within a borehole. Boreholes may be made up of a single passage, multiple passages, connected passages and combinations thereof, in a situation where multiple boreholes are connected or interconnected each borehole would have a borehole bottom. Boreholes may be formed in the sea floor, under bodies of water, on land, in ice formations, or in other locations and settings.

Boreholes are generally formed and advanced by using mechanical drilling equipment having a rotating drilling tool, e.g., a bit. For example and in general, when creating a borehole in the earth, a drilling bit is extending to and into the earth and rotated to create a hole in the earth. In general, to perform the drilling operation the bit must be forced against the material to be removed with a sufficient force to exceed the shear strength, compressive strength or combinations thereof, of that material. Thus, in conventional drilling activity mechanical forces exceeding these strengths of the rock or earth must be applied. The material that is cut from the earth is generally known as cuttings, e.g., waste, which may be chips of rock, dust, rock fibers and other types of materials and structures that may be created by the bit's interactions with the earth. These cuttings are typically removed from the borehole by the use of fluids, which fluids can be liquids, foams or gases, or other materials know to the art.

As used herein, unless specified otherwise, the term "advancing" a borehole should be given its broadest possible meaning and includes increasing the length of the borehole. Thus, by advancing a borehole, provided the orientation is less than 90° the depth of the borehole may also increased. The true vertical depth ("TVD") of a borehole is the distance from the top or surface of the borehole to the depth at which the bottom of the borehole is located, measured along a straight vertical line. The measured depth ("MD") of a borehole is the distance as measured along the actual path of the borehole from the top or surface to the bottom. As used herein unless specified otherwise the term depth of a borehole will refer to MD. In general, a point of reference may be used for the top of the borehole, such as the rotary table, drill floor, well head or initial opening or surface of the structure in which the borehole is placed.

As used herein, unless specified otherwise, the term "drill pipe" is to be given its broadest possible meaning and includes all forms of pipe used for drilling activities; and refers to a single section or piece of pipe. As used herein the terms "stand of drill pipe," "drill pipe stand," "stand of pipe," "stand" and similar type terms should be given their broadest possible meaning and include two, three or four sections of drill pipe that have been connected, e.g., joined together, typically by joints having threaded connections. As used herein the terms "drill string," "string," "string of drill pipe," string of pipe" and similar type terms should be given their broadest definition and would include a stand or stands joined together for the purpose of being employed in a borehole. Thus, a drill string could include many stands and many hundreds of sections of drill pipe.

As used herein, unless specified otherwise, the term "tubular" is to be given its broadest possible meaning and includes drill pipe, casing, riser, coiled tube, composite tube, vacuum insulated tubing ("VIT), production tubing and any similar structures having at least one channel therein that are, or could be used, in the drilling industry. As used herein the term "joint" is to be given its broadest possible meaning and includes all types of devices, systems, methods, structures and components used to connect tubulars together, such as for example, threaded pipe joints and bolted flanges. For drill pipe joints, the joint section typically has a thicker wall than the rest of the drill pipe. As used herein the thickness of the wall of tubular is the thickness of the material between the internal diameter of the tubular and the external diameter of the tubular.

As used herein, unless specified otherwise, the terms "blowout preventer," "BOP," and "BOP stack" should be given their broadest possible meanings, and include: (i) devices positioned at or near the borehole surface, e.g., the surface of the earth including dry land or the seafloor, which are used to contain or manage pressures or flows associated with a borehole; (ii) devices for containing or managing pressures or flows in a borehole that are associated with a subsea riser or a connector; (iii) devices having any number and combination of gates, valves or elastomeric packers for controlling or managing borehole pressures or flows; (iv) a subsea BOP stack, which stack could contain, for example, ram shears, pipe rams, blind rams and annular preventers; and, (v) other such similar combinations and assemblies of flow and pressure management devices to control borehole pressures, flows or both and, in particular, to control or manage emergency flow or pressure situations.

As used herein, unless specified otherwise, the terms "removal of material," "removing material," "remove" and similar such terms should be given their broadest possible meanings. Thus, such terms would include melting, flowing, vaporization, softening, laser induced break down, ablation; as well as, combinations and variations of these, and other processes and phenomena that can occur when directed energy from a laser beam is delivered to a material, object or work surface. Such terms would further include combinations of the forgoing laser induced processes and phenomena with the energy that the fluid jet imparts to the material to be cut. Moreover, irrespective of the processes or phenomena taking place, such terms would include the lessening, opening, cutting, severing or sectioning of the material, object or targeted structure.

As used herein, unless specified otherwise, the terms "workover," "completion" and "workover and completion" and similar such terms should be given their broadest possible meanings and would include activities that place at or near the completion of drilling a well, activities that take place at or the near the commencement of production from the well, activities that take place on the well when the well is a producing or operating well, activities that take place to reopen or reenter an abandoned or plugged well or branch of a well, and would also include for example, perforating, cementing, acidizing, fracturing, pressure testing, the removal of well debris, removal of plugs, insertion or replacement of production tubing, forming windows in casing to drill or complete lateral or branch wellbores, cutting and milling operations in general, insertion of screens, stimulating, cleaning, testing, analyzing and other such activities. These terms would further include applying heat, directed energy, preferably in the form of a high power laser beam to heat, melt, soften, activate, vaporize, disengage, desiccate and combinations and variations of these, materials in a well, or other structure, to remove, assist in their removal, cleanout, condition and combinations and variation of these, such materials.

As used herein, unless specified otherwise, the terms "conveyance structure", "umbilical", "line structure" and similar such terms should be given their broadest possible meanings and may be, contain or be optically or mechanically associated with: a single high power optical fiber; a single high power optical fiber that has shielding; i a single high power optical fiber that has multiple layers of shielding; two, three or more high power optical fibers that are surrounded by a single protective layer, and each fiber may additionally have its own protective layer; a fiber support structure which may be integral with or releasable or fixedly attached to an optical fiber (e.g., a shielded optical fiber is clipped to the exterior of a metal cable and lowered by the cable into a borehole); other conduits such as a conduit to carry materials to assist a laser cutter, for example gas, air, nitrogen, oxygen, inert gases; other optical fibers or metal wires for the transmission of data and control information and signals; and any combinations and variations thereof.

The conveyance structure transmits high power laser energy from the laser to a location where high power laser energy is to be utilized or a high power laser activity is to be performed by, for example, a high power laser tool. The conveyance structure may, and preferably in some applications does, also serve as a conveyance device for the high power laser tool. The conveyance structure's design or configuration may range from a single optical fiber, to a simple to complex arrangement of fibers, support cables, shielding on other structures, depending upon such factors as the environmental conditions of use, performance requirements for the laser process, safety requirements, tool requirements both laser and non-laser support materials, tool function(s), power requirements, information and data gathering and transmitting requirements, control requirements, and combinations and variations of these.

Preferably, the conveyance structure may be coiled tubing, a tube within the coiled tubing, jointed drill pipe, jointed drill pipe having a pipe within a pipe, or may be any other type of line structure, that has a high power optical fiber associated with it. As used herein the term "line structure" should be given its broadest meaning, unless specifically stated otherwise, and would include without limitation: wireline; coiled tubing; slick line; logging cable; cable structures used for completion, workover, drilling, seismic, sensing, and logging; cable structures used for subsea completion and other subsea activities; umbilicals; cables structures used for scale removal, wax removal, pipe cleaning, casing cleaning, cleaning of other tubulars; cables used for ROV control power and data transmission; lines structures made from steel, wire and composite materials, such as carbon fiber, wire and mesh; line structures used for monitoring and evaluating pipeline and boreholes; and would include without limitation such structures as Power & Data Composite Coiled Tubing (PDT-COIL) and structures such as Smart Pipe® and FLATpak®.

Drilling Wells and Perforating Activities

Typically, and by way of general illustration, in drilling a well an initial borehole is made into the earth or seabed and then subsequent and smaller diameter boreholes are drilled to extend the overall depth of the borehole. Thus, as the overall borehole gets deeper its diameter becomes smaller; resulting in what can be envisioned as a telescoping assembly of holes with the largest diameter hole being at the top of the borehole closest to the surface of the earth.

Thus, by way of example, the starting phases of a subsea drill process may be explained in general as follows. Once the drilling rig is positioned on the surface of the water over the area where drilling is to take place, an initial borehole is made by drilling a 36" hole in the earth to a depth of about 200-300 ft. below the seafloor. A 30" casing is inserted into this initial borehole. This 30" casing may also be called a conductor. The 30" conductor may or may not be cemented into place. During this drilling operation a riser is generally not used and the cuttings from the borehole, e.g., the earth and other material removed from the borehole by the drilling activity, are returned to the seafloor. Next, a 26" diameter borehole is drilled within the 30" casing, extending the depth of the borehole to about 1,000-1,500 ft. This drilling operation may also be conducted without using a riser. A 20" casing is then inserted into the 30" conductor and 26" borehole. This 20" casing is cemented into place. The 20" casing has a wellhead secured to it. (In other operations an additional smaller diameter borehole may be drilled, and a smaller diameter casing inserted into that borehole with the wellhead being secured to that smaller diameter casing.) A BOP is then secured to a riser and lowered by the riser to the sea floor; where the BOP is secured to the wellhead. From this point forward all drilling activity in the borehole takes place through the riser and the BOP.

For a land based drill process, the steps are similar, although the large diameter tubulars, 30"-20" are typically not used. Thus, and generally, there is a surface casing that is typically about 13⅜" diameter. This may extend from the surface, e.g., wellhead and BOP, to depths of tens of feet to hundreds of feet. One of the purposes of the surface casing is to meet environmental concerns in protecting ground water. The surface casing should have sufficiently large diameter to allow the drill string, product equipment such as ESPs and circulation mud to pass by. Below the casing one or more different diameter intermediate casings may be used. (It is understood that sections of a borehole may not be cased, which sections are referred to as open hole.) These can have diameters in the range of about 9" to about 7", although larger and smaller sizes may be used, and can extend to depths of thousands and tens of thousands of feet. Inside of the casing and extending from a pay zone, or production zone of the bore hole up to and through the wellhead on the surface is the production tubing. There may be a single production tubing or multiple production tubings in a single borehole, with each of the production tubing ending at different depths.

Typically, when completing a well, it is necessary to perform a perforation operation, and also in some instances perform a hydraulic fracturing, or fracing operation. In general, when a well has been drilled casing, i.e., a metal pipe, and typically cement placed between the casing and the earth, i.e., the formation, prevents the earth from falling back into the hole. (In some situations only the metal casing is present, in others there may be two metal casing present one inside of the other, in still others the metal casing and cement are present, and in others there could be other configurations of metal, cement and metal.) Thus, this casing forms a structural support for the well and a barrier to the earth.

While important for the structural integrity of the well, the casing and cement present a problem when they are in the production zone. Thus, in addition to holding back the earth, they also prevent the hydrocarbons from flowing into the well and from being recovered. Additionally, the formation itself may have been damaged by the drilling process, e.g., by the pressure from the drilling mud, and this damaged area of the formation may form an additional barrier to the flow of hydrocarbons into the well. Similarly, in most situations where casing is not needed in the production area, the formation itself is very tight and will not permit the hydrocarbons to flow into the well. (In some situations the formation pressure is large enough that the hydrocarbons readily flow into the well in an uncased, or open hole. Nevertheless, as formation pressure lessens a point will be reached where the formation itself shuts-off, or significantly reduces, the flow of hydrocarbons into the well.)

To overcome this problem of the flow of hydrocarbons into the well being blocked by the casing, cement and the formation itself, perforations are made in the well in the area of the pay zone. A perforation is a small, about ¼" to about 1" or 2" in diameter hole that extends through the casing, cement and damaged formation and goes into the formation. This hole creates a passage for the hydrocarbons to flow from the formation into the well. In a typical well a large number of these holes are made through the casing and into the formation in the pay zone.

Generally, in a perforating operation a perforating tool or gun is lowered into borehole to the location where the production zone or pay zone is located. The perforating gun is a long, typically round tool, that has a small enough diameter to fit into the casing and reach the area within the borehole where the production zone is believed to be. Once positioned in the production zone a series of explosive charges, e.g., shaped charges, are ignited. The hot gases and molten metal from the explosion cut a hole, i.e., the pert or perforation, through the casing and into the formation. These explosive made perforation, may only extend a few inches, e.g., 6" into the formation. In hard rock formations the explosive perforation device may only extend an inch or so, and may function poorly, if at all. Additionally, because these perforations are made with explosives they typically have damages areas, which include, loose rock and perforation debris along the bottom of the hole; and a damaged zone extending annularly around the hole. Beyond the damaged zone is a virgin zone extending annularly around the damage zone. The damage zone, which typically encompasses the entire hole generally greatly reduces the permeability of the formation. This has been a long standing, and unsolved problem in the use of explosive perforations. The perforation holes are made to get through one group of obstructions to the flow of hydrocarbons into the well, e.g., the casing, and in doing so they create a new group of these obstructions, e.g., the damage area encompassing the perforation holes.

Generally, in a hydraulic fracturing operation once the perforations have been made a mixture of typically a water based fluid with sand or other small particles is forced into the well, into the perforations and out into the formation. For example, for a single well 3-5 million gallons of water may be used and pressures may be in the range of about 500 psi to 2,000 psi and can go as high as 3,000 psi and potentially higher. As the water and sand are forced into the formation under these very high pressures, they cause the rock to break at weak points in the formation. These breaks usually occur along planes of weakness and are called joints. Naturally occurring joints in the formation may also be further separated, e.g., expanded, and propagated, e.g., lengthened, by the water pressure. In order the keep these newly formed and enlarged joints open, once the pressure and water are removed, the sand or propants, are left behind. They in essence hold open, i.e., prop open, the newly formed and enlarged joints in the formation.

Additionally, hydraulic fracturing has come under public and consequentially regulatory scrutiny for environmental reasons. This scrutiny has looked to such factors as: the large amounts of water used; the large amounts of vehicles, roads and other infrastructure needed to perform a fracturing operation; potential risks to ground water; potential risks of seismic activities; and potential risks from additives to the water, among other things.

SUMMARY

In the acquisition of energy sources, such as oil and natural gas, there exists a long felt need to have safe, controllable and predictable ways to establish and enhance fluid communication between the hydrocarbon reservoir in the formation and the well bore. Incremental improvements in explosive perforating guns and techniques have not met these long felt needs. It is the present inventions, among other things, that solve these needs by providing the articles of manufacture, devices and processes taught herein.

Thus, there is provided herein a method of enhancing fluid communication between a borehole and a hydrocarbon reservoir in a formation, the method including: obtaining data about the geological properties of a formation containing a hydrocarbon reservoir; inserting a high power laser tool into a borehole, and advancing the laser tool to a predetermined location within the borehole; placing the laser tool in optical and control communication with a high power laser delivery system; based, at least in part, on the formation data, determining a laser energy delivery pattern; wherein, the laser energy delivery pattern comprises a plurality of laser perforations for predetermined locations in the formation; and, the laser delivery system and laser tool delivering the laser energy delivery pattern to the predetermined location within the borehole; whereby, the laser energy creates a custom geometry in the formation enhancing fluid communication between the borehole and the hydrocarbon reservoir.

Additionally, there is provided a method of doing a laser enhanced hydraulic fracturing operation to enhance fluid communication between a borehole and a hydrocarbon reservoir in a formation, the method including: obtaining data about the geological properties of a formation containing a hydrocarbon reservoir; obtaining a hydraulic fracturing plan for the formation; inserting a high power laser tool into a borehole, and advancing the laser tool to a predetermined location within the borehole; placing the laser tool in optical and control communication with a high power laser delivery system; based, at least in part, on the formation data and the hydraulic fracturing plan, determining a laser energy delivery pattern; wherein, the laser pattern comprises a plurality of laser perforations for predetermined locations in the formation; the laser delivery system and laser tool delivering the laser pattern to the predetermined location within the borehole; and, hydraulic fracturing the formation based at least in part upon the hydraulic fracturing plan; whereby, the laser energy creates a custom geometry in the formation enhancing the hydraulic fracturing of the formation and thereby enhancing the fluid communication between the borehole and the hydrocarbon reservoir in the formation. This method may further include the hydraulic fracturing plan being based at least in part upon the custom geometry.

Further, there is further provided high power laser perforation methods that may include one of more of: a total internal reflection prism; at least one laser perforation extending at least about 3 inches from the borehole side wall; at least one laser perforation extending at least about 10 inches from the borehole side wall; at least one laser perforation extends at least about 20 inches from the borehole side wall; the laser tool having a Risley prism; the having a passive vertical position determining sub; the laser tool comprises an angled fluid jet intersecting a laser beam path; having at least about 50 perforations; having a pie shaped perforation.

DESCRIPTION OF THE PREFERRED EMBODIMENTS

In general, the present inventions relate to systems, methods and tools to establish and enhance fluid communication between the hydrocarbon reservoir in the formation and the well bore. In particular, the present inventions relate to high power laser tools for perforating, fracturing, and opening, increasing and enhancing the flow of energy sources, such as hydrocarbons and geothermal, from a formation into a production tubing or collection system. The present inventions provided improved performance and safety over conventional explosive based perforating guns, as well as providing for the precise and predetermined placement of laser beam energy, in precise and predetermined energy distribution patterns. These patterns can be tailored and customized to the particular geological and structural features of a formation and pay zone; thus giving rise to never before seen customization of perforating and fracturing patents to precisely match the formation.

In general, and by way of illustration, a laser perforating tool may have several components or sections. The tool may have a one or more of these and similar types of sections: a conveyance structure, a guide assembly, a cable head, a roller section, a casing collar locating section, a swivel, a LWD/MWD section, a vertical positioning section, a tractor, a packer or packer section, an alignment or orientation section, laser directing aiming section, and a laser head. These components or sections may be arranged in different orders and positions going from top to bottom of the tool. In general and unless specified otherwise, the bottom of the tool is that end which first enters the borehole and the top of the tool is that section which last enters the borehole and typically is attached to or first receives the conveyance structure. It is further understood that one component in the tool may perform the functions of two or more other components; that the functions of a single component may be performed by one two or more components; and combinations and variations of these.

Figure 1:
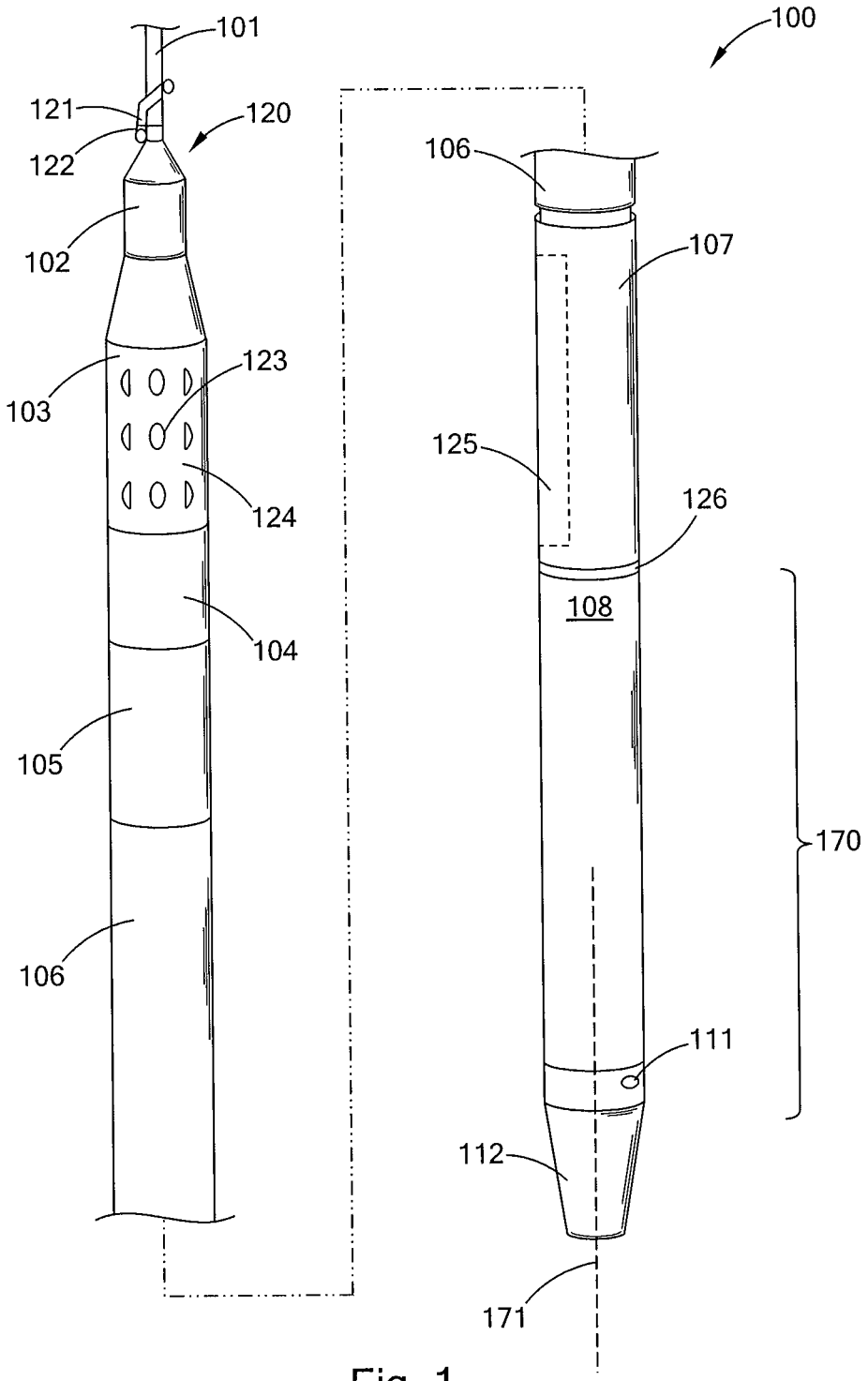
FIG. 1 is a perspective view of an embodiment of a laser perforating tool in accordance with the present inventions.

Turning to FIG. 1 there is provided a perspective view of an embodiment of a laser perforating tool with a conveyance structure attached. The laser perforating tool 100 contains several connectable and cooperatively operable subassemblies forming an elongated housing that may be joined together by threaded unions, or other connecting means know to the art, into an operable piece of equipment for use. At the top 120 of tool 100 is a conveyance structure 101, which is mounted with the tool 100 at a cable head 102. A guide assembly 121 is mounted around conveyance structure 101 immediately above cable head 102. Housing guide assembly 121 is freely rotatedly mounted around the conveyance structure 101 and provided with a roller or wheel and a sliding shoe or guide portion 122 which enables the tool to be pulled into a reduced diameter aperture such as when the tool is pulled from a lower portion of well casing through a bulkhead or the like into a shorter tubing string. Guide assembly 121 prevents the upper end portion of cable head 102 from becoming stuck or wedged against the obstruction created by a reduced diameter aperture within a well casing. Adjacent cable head 102 is upper roller assembly 103. Upper roller assembly 103 contains a number of individual rollers, e.g., 123 mounted in a space relation around and longitudinally along this section. Rollers 123 protrude from the outer surface 124 of the upper roller assembly housing in order to support the housing on the interior tubular surface presented by well casing and tubing. Rollers 123 in this roller assembly can be constructed with low friction bearings and/or materials so that rotation of the rollers requires very little force, other devices for reducing the force required for movement through the borehole, know to those of skill in the art may also be used. This construction assists in longitudinal movement of the housing through the tubing and casing of a well by significantly reducing the force required to accomplish such movement. Below upper roller assembly 103 is a connecting segment 104 which joins a casing collar locator 105. Casing collar locator 105 is used to locate the collars within a casing of a well. In perforating operations it is typical to locate several collars within a well in order to determine the exact position of the zone of interest that is to be perforated, other instruments and assemblies may also be used to make this determination.

With explosive perforation it was necessary or suggested to locate collars within the casing in order to position the explosive perforating tool such that it would not attempt to perforate the casing through a collar. The laser perforating tools have over come this problem and restriction. The laser beam and laser cutting heads can readily cut a perforation hole through a casing collar or joint of any size.

Immediately below casing collar locator 105 is a swivel sub 106. Swivel sub 106 is constructed with overlapping internal and external members that provide for a rigid longitudinal connection between upper and lower portions of the housing while at the same time providing for free rotational movement between adjoining upper and lower portions of the housing.

Immediately below swivel sub 106 in the housing is an eccentrically weighted sub 107, which provides for passive vertical orientation, positioning, of the laser sub assembly 170. Eccentric weight sub 107 contains a substantially dense weight, e.g., depleted uranium, that is positioned in an eccentric relation to the longitudinal axis of the housing. This eccentric weight 125 is illustrated in dashed lines in its eccentric position relative to the longitudinal axis of this sub. The position of eccentric weight 125 is on what will be referred to as the bottom portion of the housing and the laser sub 170. Due to the mass of weight 125 being selected as substantially larger than the mass of the adjacent portion of the apparatus housing this weight will cause the housing to rotate to an orientation placing weight 125 in a downwardly oriented direction. This is facilitated by the presence of swivel sub 106. Immediately below eccentric weight sub 107 is an alignment joint sub indicated at 126. Alignment joint 126 is used to correctly connect eccentric weight sub 107 with the laser sub 170 so that the bottom portion of the housing will be in alignment with the laser beam aiming and directing systems in the laser sub 170.

Laser sub assembly 170 contains several components within its housing 108. These components or assemblies would include controllers, circuitry, motors and sensors for operating and monitoring the delivery of the laser beam, an optics assembly for shaping and focusing the laser beam, a beam aiming and directing assembly for precisely directing the laser beam to a predetermined location within the borehole and in a predetermined orientation with respect to the axis 171 of the laser sub 170, the beam aiming and directing system may also contain a beam path verification system to make certain that the laser beam has a free path to the casing wall or structure to be perforated and does not inadvertently cut through a second string or other structure located within the casing, a laser cutting head which is operably associated with, or includes, in whole or in part, the optics assembly and the beam aiming and directing assembly components, a laser beam launch opening 111, and an end cone 112. The laser sub 170 may also contain a roller section or other section to assist in the movement of the tool through the borehole.

Subassemblies and systems for orienting a tool in a well may include for example, gravity based systems such as those disclosed and taught in U.S. Pat. Nos. 4,410,051, 4,637,478, 5,101,964, and 5,211,714, the entire disclosures of each of which are incorporated herein by reference, laser gyroscopes, gyroscopes, fiber gyros, fiber gravimeter, and other devices and system known to the art for deterring true vertical in a borehole.

Figure 1A:
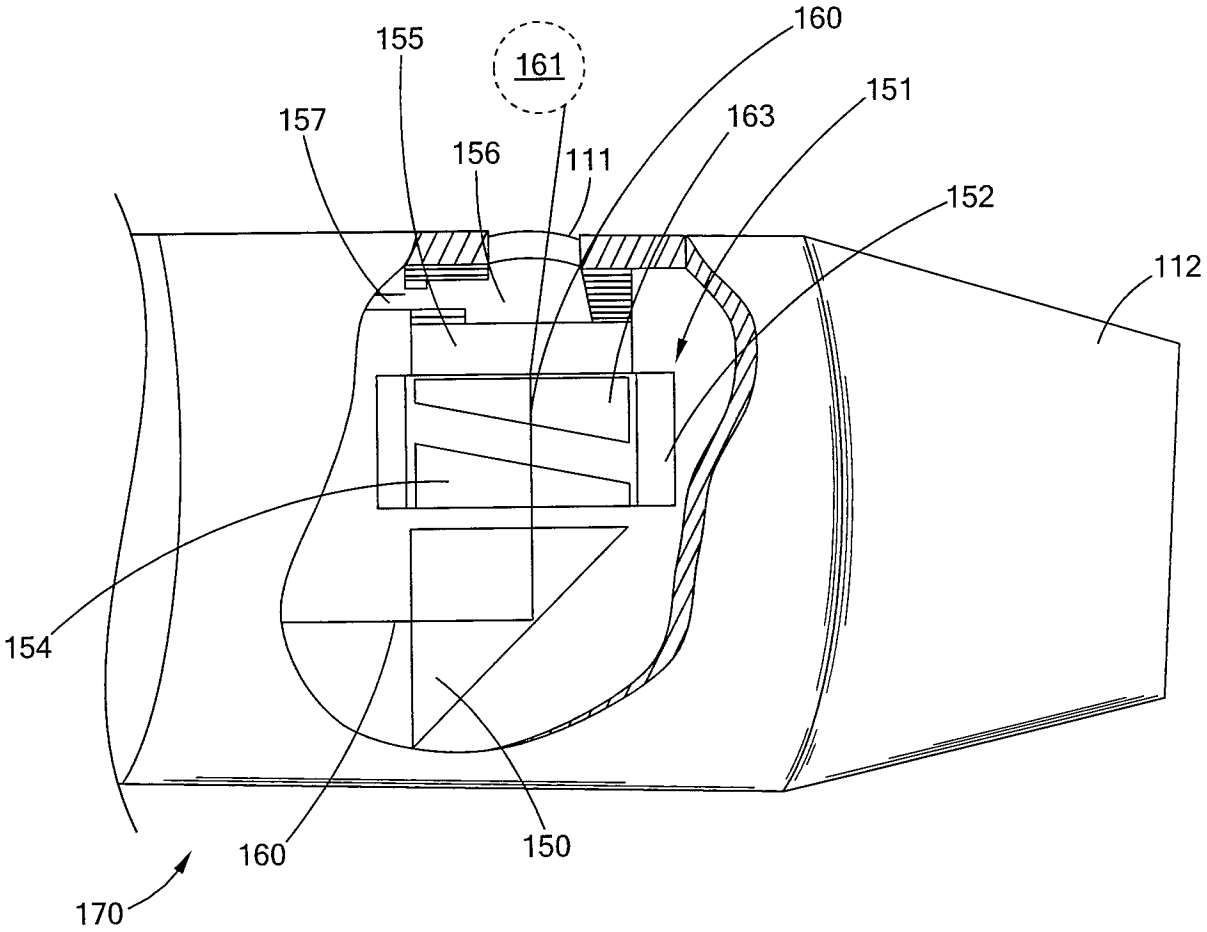
FIG. 1A is a cutaway perspective view of an embodiment of a laser perforating head in accordance with the present inventions.

Turning to FIG. 1A there is shown a cut away perspective view of the laser perforating sub assembly 170. The laser beam traveling along beam path 160, from optics assembly (not shown in the Figure) enters TIR prism 150 (Total internal reflection (TIR) prisms, and their use in high power laser tools is taught and disclosed in U.S. patent application Ser. No. 13/868,149, the entire disclosure of which is incorporated herein by reference.) It is noted that other forms of mirrors and reflective surfaces may be used, however these are not preferred. From TIR prism 150 the laser beam traveling along beam path 160 enters a pair of optical wedges 153, 154, which are commonly called Risley Prisms, and which are held and controlled by Risley Prism mechanism 152. As the prisms are rotted about the axis of the laser beam path 160 they will have the effect of steering the laser beam, such that depending upon the relative positions of the prisms 153, 154 the laser beam can be directed to any point in area 161 and can be moved in any pattern within that area. There is further provided a window 157 that is adjacent a nozzle assembly 156 that has a source of a fluid 157.

The conveyance structure transmits high power laser energy from the laser to a location where high power laser energy is to be utilized or a high power laser activity is to be performed by, for example, a high power laser tool. The conveyance structure may, and preferably in some applications does, also serve as a conveyance device for the high power laser tool. The conveyance structure's design or configuration may range from a single optical fiber, to a simple to complex arrangement of fibers, support cables, shielding on other structures, depending upon such factors as the environmental conditions of use, performance requirements for the laser process, safety requirements, tool requirements both laser and non-laser support materials, tool function(s), power requirements, information and data gathering and transmitting requirements, control requirements, and combinations and variations of these.

Preferably, the conveyance structure may be coiled tubing, a tube within the coiled tubing, jointed drill pipe, jointed drill pipe having a pipe within a pipe, or may be any other type of line structure, that has a high power optical fiber associated with it. As used herein the term line structure should be given its broadest meaning, unless specifically stated otherwise, and would include without limitation: wireline; coiled tubing; slick line; logging cable; cable structures used for completion, workover, drilling, seismic, sensing, and logging; cable structures used for subsea completion and other subsea activities; umbilicals; cables structures used for scale removal, wax removal, pipe cleaning, casing cleaning, cleaning of other tubulars; cables used for ROV control power and data transmission; lines structures made from steel, wire and composite materials, such as carbon fiber, wire and mesh; line structures used for monitoring and evaluating pipeline and boreholes; and would include without limitation such structures as Power & Data Composite Coiled Tubing (PDT-COIL) and structures such as Smart Pipe® and FLATpak®.

Conveyance structures would include without limitation all of the high power laser transmission structures and configurations disclosed and taught in the following US Patent Applications Publication Nos.: 2010/0044106; 2010/0215326; 2010/0044103; 2012/0020631; 2012/0068006; and 2012/0266803, the entire disclosures of each of which are incorporated herein by reference.

Generally, the location and position of the beam waist of the laser beam can be varied with respect to the borehole surface, e.g., casing or formation, in which the perforation hole is to be cut. By varying the position of the beam waist different laser material processes may take place and different shape perforations may be obtained. Thus, and for example, for forming deep penetrations into the formation, the proximal end of the beam waist could be located at the borehole. Many other relative positions of the focal point, the laser beam optimum cutting portion, the beam waste, and the point where the laser beam path initially intersects the borehole surface may be used. Thus, for example, the focal point may be about 1 inch, about 2 inches, about 10 inches, about 15 inches, about 20 inches, or more into (e.g., away from the casing or borehole surface) or within the formation.

Figure 2:
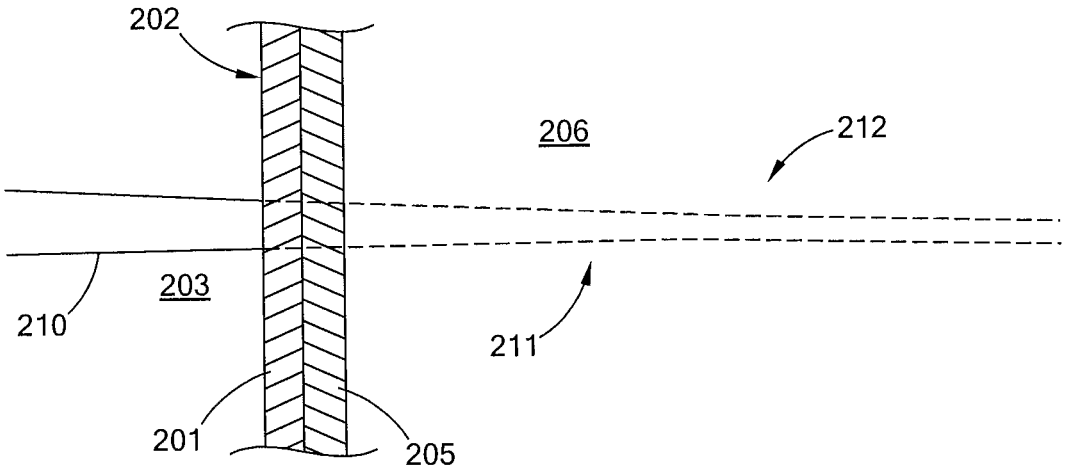
FIG. 2 is a schematic of an embodiment of a laser beam profile in accordance with the present invention.

The beam waist in many applications is preferably in the area of the maximum depth of the cut. In this manner the hole opens up toward the face (front surface) of the borehole, which further helps the molten material to flow from the perforation hole. Thus turning to FIG. 2 there is shown a casing 201 in a borehole 203 having a front or inner face 202. Between the casing 201 and the formation 206 is cement 205. A laser beam 210 that is launched from a laser perforation tool (not shown in this figure) travels along laser beam path 211 in a predetermined beam profile, which is provided by the laser optical assembly in the tool. The predetermined beam profile provides for a beam waist 212, which is positioned deep within the formation 206 behind the casing 201 and cement 205. Thus, the perforation hole may be about 5 inches, about 10 inches, about 15 inches, about 20 inches or more, or deeper into the formation. Additionally, damaged areas, that are typically present when explosives are used, such as loose rock and perforation debris along the bottom of the hole and a damaged zone extending annularly around the hole, preferably are not present in the laser perforation. Further this preferred positioning of the beam waist, deep within the formation, may also provide higher rates of penetration.

Figure 3A:
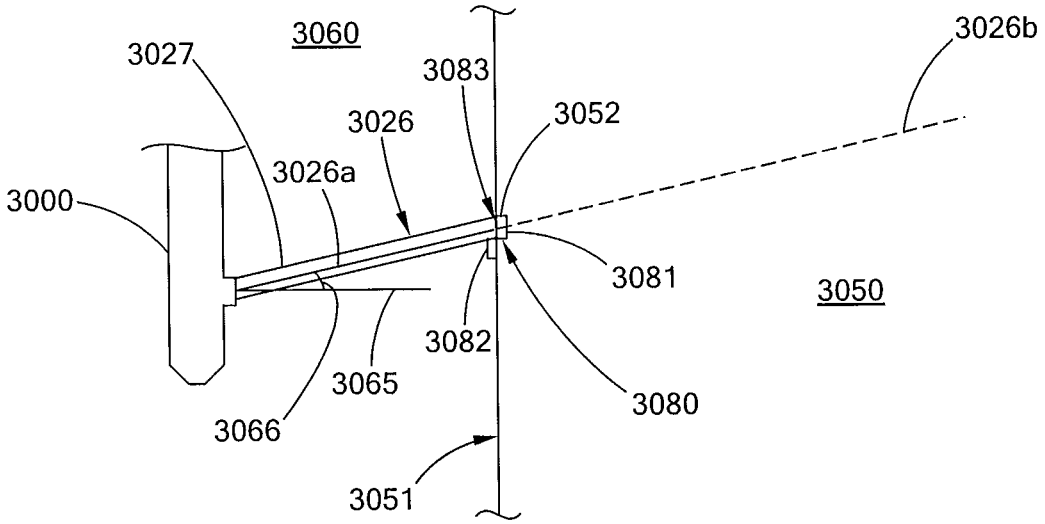
FIGS. 3A to 3C are schematic snap shots of an embodiment of a process in accordance with the present inventions.
Figure 3B:
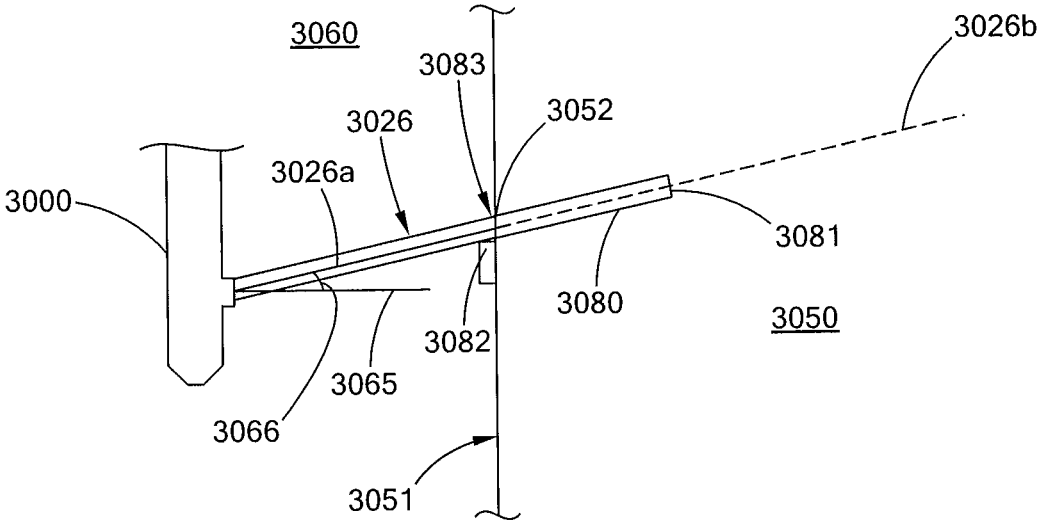
Figure 3C:
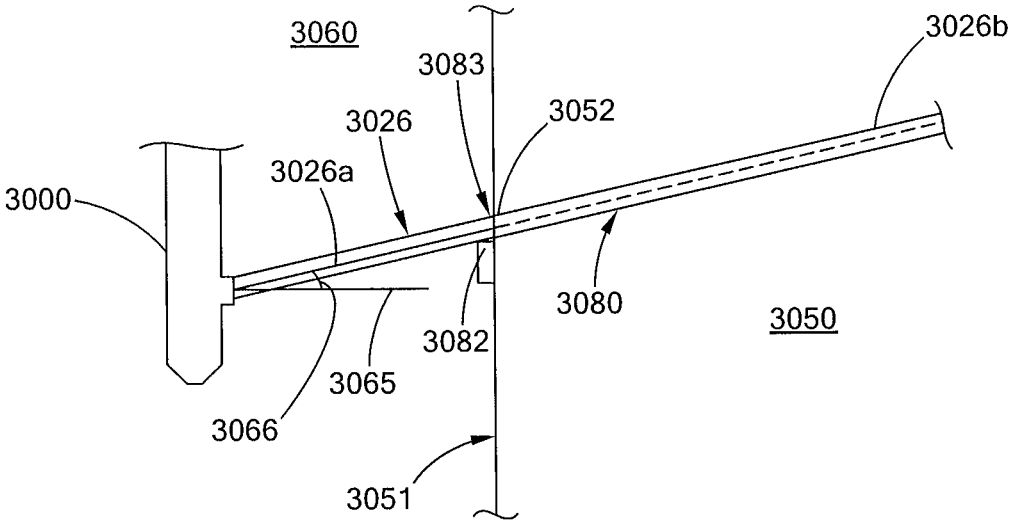

Turning to FIG. 3A through 3C there are provided side cross-sectional schematic snap shot views of an embodiment of a laser operation forming a hole, or perforation, into a formation. Thus, turning to FIG. 3A, in the beginning of the operation the laser tool 3000 is firing a laser beam 3027 along laser beam path 3026, and specifically along section 3026*a* of the beam path. Beam path section 3026*a* is in the wellbore free space 3060, this distance may be essential zero, but is shown a greater for the purpose of illustrating the process. Note, that wellbore free space refers to the fact that the laser has been launched from its last optical element and is no longer traveling in an optical fiber, a lens, a window or other optical element. This environment may be anything but free from fluids; and, if wellbore fluids are present as discussed and taught below other laser cutting techniques can be used if need. The laser beam path 3026 has a 16° beam path angle 3066 formed with horizontal line 3065. The laser beam path 3026 and the laser beam 3027 traveling along that beam path intersect the bore hole face 3051 of the formation 3050 at spot 3052. In this embodiment the proximal end of the laser beam waist section is located at spot 3052. The hole or perforation 3080 is beginning to form, as it can be seen that the bottom, or distal, surface 3081 of the hole 3080 is below surface 3051, along beam path 3026*b*, and within the target material 3050. As can be seen from this figure the hole 3080 is forming with a downward slope from the bottom of the hole 3081 to the hole opening 3083. The molten target material 3082 that has flowed from the hole 3080 cools and accumulates below the hole opening 3083.

Turning to FIG. 3B the hole 3081 has become longer, advancing deeper into the formation 3050. In general, the hole advances along beam path 3026*a*. Thus, the bottom 3081 of the hole is on the beam path 3026*b* and deeper within the formation, e.g., further from the opening 3083, than it was in FIG. 3A.

Turning now to FIG. 3C the hole 3081 has been substantially advanced to the extent that the bottom of the hole is no longer visible in the figure. The amount of molten material 3082 that has flowed from the hole 3081 has continued to grow. In this embodiment the length of hole 3082 is substantially longer than the length of the beam waist. The diameter, or cross sectional size of the hole, however does not increase as might be expected in the area distal to the beam waist. Instead, the diameter remains constant, or may even slightly decrease. It is theorized, although not being bound by this theory, that this effect occurs because the optical properties of the hole, and in particular the molten and semi-molten inner surfaces of the hole, are such that they prevent the laser beam from expanding after it is past, i.e., distal to, the beam waist. Further, and again not being bound by this theory, the inner surfaces may absorb the expanding portions of the laser beam after passing through the waist, the inner surfaces may reflect the expanding portions of the laser beam, in effect creating a light pipe within the hole, or the overall conditions within the hole may create a waive guide, and combinations and variations of these. Thus, the depth or length of the hole can be substantially, and potentially may orders of magnitude greater than the length of the beam waist.

Figure 16:
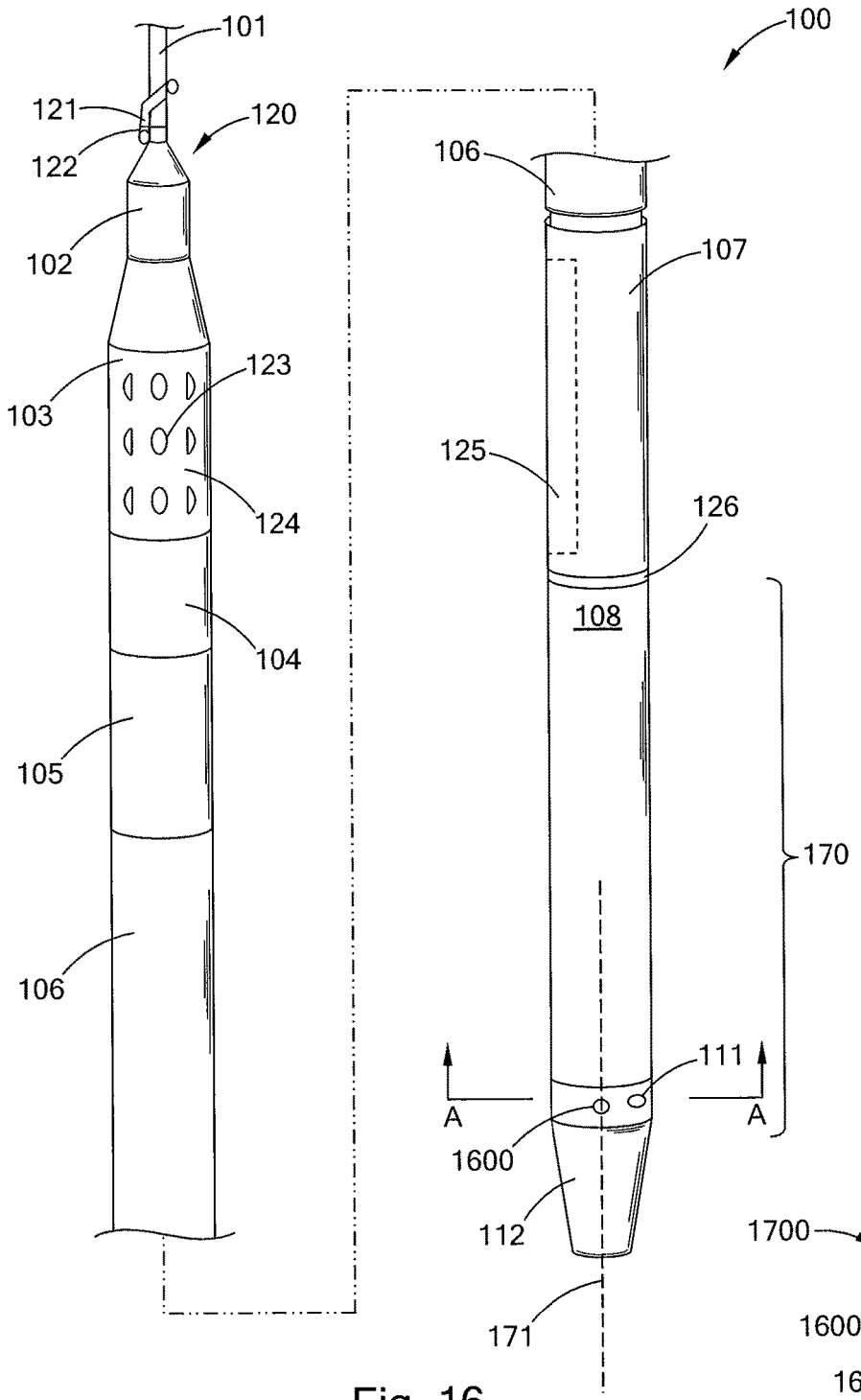
FIG. 16 is perspective view of an embodiment of a laser perforating tool in accordance with the present inventions.
Figure 16A:
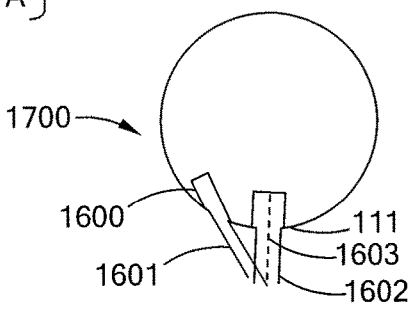
FIG. 16A is cross sectional view of the embodiment of FIG. 16 as taken along line A-A of FIG. 16.

While an upward beam angle is used in the illustrative process of FIGS. 3A to 3C, perforations that are essentially horizontal or that have beam angles that are below horizontal, i.e., sloping downward from the hole opening or vertically downward from the hole opening, may also be made. In upward beam angle operations the need for a fluid assist to clear the perforation hole as it is advanced is greatly reduced, if not entirely eliminated. The perforation hole will advance without the need for any fluid assist, e.g., air or water to remove the molten or laser effected material from the hole. In the horizontal hole, if the slope of the holes sides are great enough this hole may also be advanced without fluid assist. In other horizontal holes, and in holes having a beam angle below horizontal a fluid assist may be required, depending upon laser power, shape of the perforation, formation material and other factors. For example, turning to FIGS. 16 and 16A there is provided the laser perforating tool 100 of the embodiment of FIG. 1 (as such like numbers refer to like structures and components). However, the laser head in the laser sub 170 has an angled fluid jet nozzle 1600. In FIG. 16A, which is a cross section along line A-A of FIG. 16, it is shown how the angled fluid jet nozzle 1600 directs the fluid jet 1601 toward the laser jet 1602 (which jets are not shown in FIG. 16). The laser beam path within jet 1602 is shown by dashed line 1603. Thus, the angled jet 1601, and in whole or in part the laser jet 1601, assists in clearing the perforation hole of debris as the perforation hole is advanced deeper into the formation.

A laser beam profile in which the laser beam energy is diverging, e.g., more energy is to the outside of the beam than in the center, may be used to make perforations that are below horizontal, including down. The laser beam having this profile creates a surface on the perforation side wall that redirects, e.g., has a channeling or focusing effect, some of the laser beams energy to the center of the beam pattern or spot on the bottom, e.g., far end, of the perforation hole.

The laser beam profile and energy delivery pattern may be used to create a modified surface, and/or structure at the point, or in the general area, where the perforation joins to the borehole, to strength the borehole in that area, which may provide additional benefits, for example, when performing hydraulic fracturing.

Figure 4:
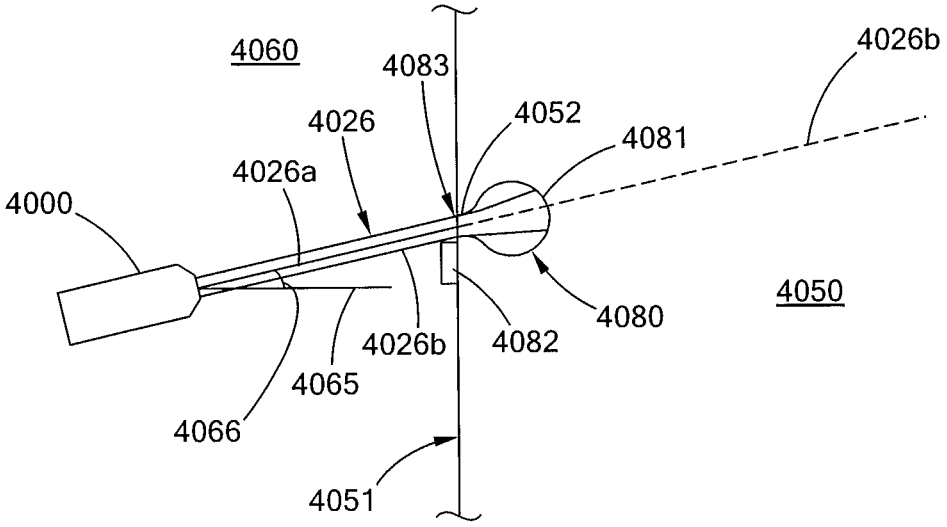
FIG. 4 is a schematic representation of an embodiment of a process in accordance with the present inventions.

Turning to FIG. 4 these is provided a schematic showing an embodiment of a laser operation in which the distal end of the beam waist is positioned away from the work surface, e.g., borehole surface, of the target material, e.g., formation. The laser tool 4000 is firing a laser beam 4027 along laser beam path 4026, which may be considered as having two section 4026*a* and 4026*b*. Beam path section 4026*a* is in wellbore free space 4060, this distance may be essential zero, but is shown a greater for the purpose of illustrating the process, and beam path 4026*b* is within the target material 4050. Note, that wellbore free space refers to the fact that the laser has been launched from its last optical element and is no longer traveling in a lens or window. This environment may be anything but free from fluids; and, if wellbore fluids are present as discussed and taught below other cutting techniques may be utilized. The laser beam path 4026 has a 22° beam path angle 4066 formed with horizontal line 4065. The laser beam path 4026 and the laser beam 4027 traveling along that beam path intersect the surface 4051 of target material 4050 at location 4052. In this embodiment the distal end 4064*b* of the laser beam waist section is not on location 4052 and is located away from surface 4051. In this embodiment the hole or perforation 4080 forms but then reaches a point where the bottom of the hole 4081 will not advance any further along the beam path 4026*b*, e.g., the hole stops forming and will not advance any deeper into the target material 4050. Further, unlike the operation of the embodiment in FIGS. 3A to 3C, the hole 4080 does not have a constant or narrowing diameter as one looks from the opening 4083 to the bottom 4081 of the hole 4080. The molten target material 4082 that has flowed from the hole 4080 cools and accumulates below the hole opening 4083. Based upon the laser beam power and other properties, this embodiment provides the ability to have precise and predetermined depth and shaped holes, in the target material and to do so without the need for measuring or monitoring devices. Once the predetermined depth is achieved, and the advancement process has stopped, regardless of how much longer the laser is fired the hole will not advance and the depth will not increase. Thus, the predetermined depth is essentially a time independent depth. This essentially automatic and predetermined stopping of the hole's advancement provides the ability to have cuts of automatic and predetermined depths, and well as, to section or otherwise remove the face of a rock formation at a predetermined depth in an essentially automatic manner.

Figure 5A:
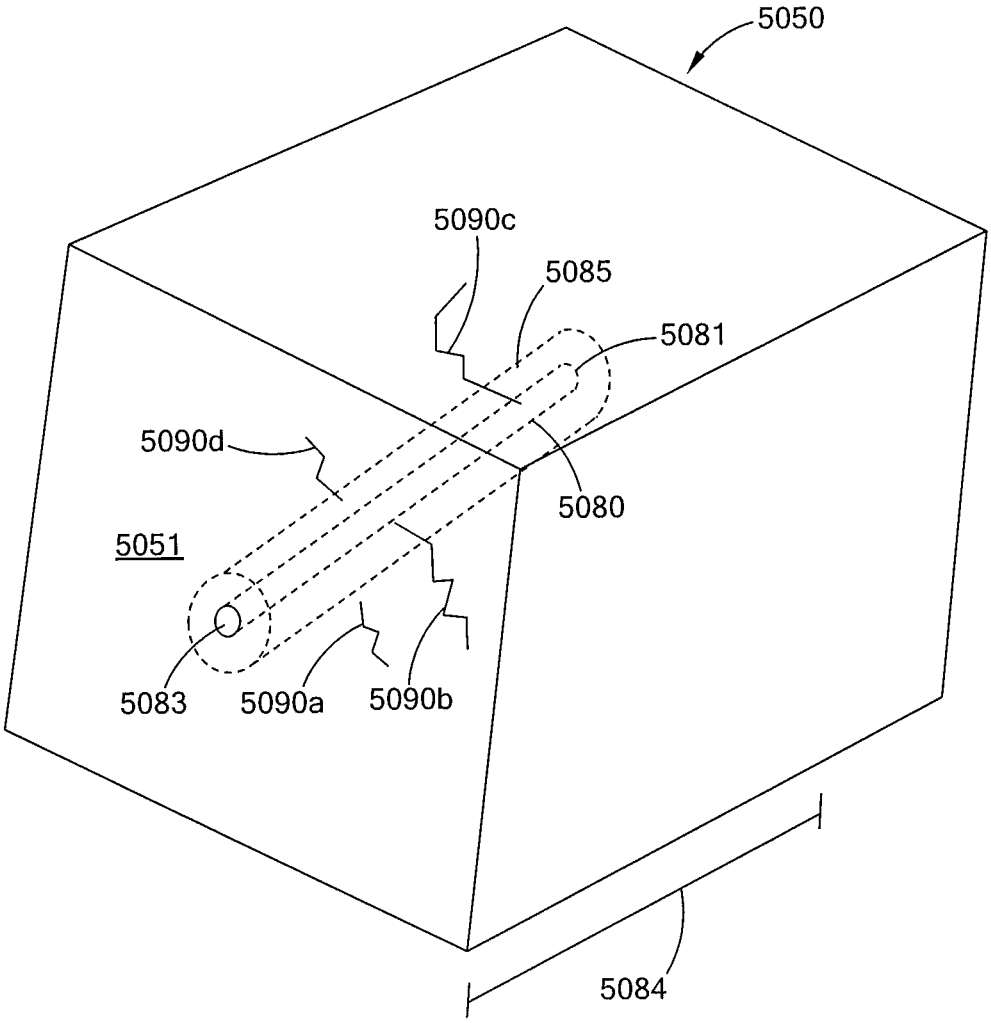
FIG. 5A is a perspective view of an embodiment of a laser energy delivery pattern in accordance with the present inventions.
Figure 5B:
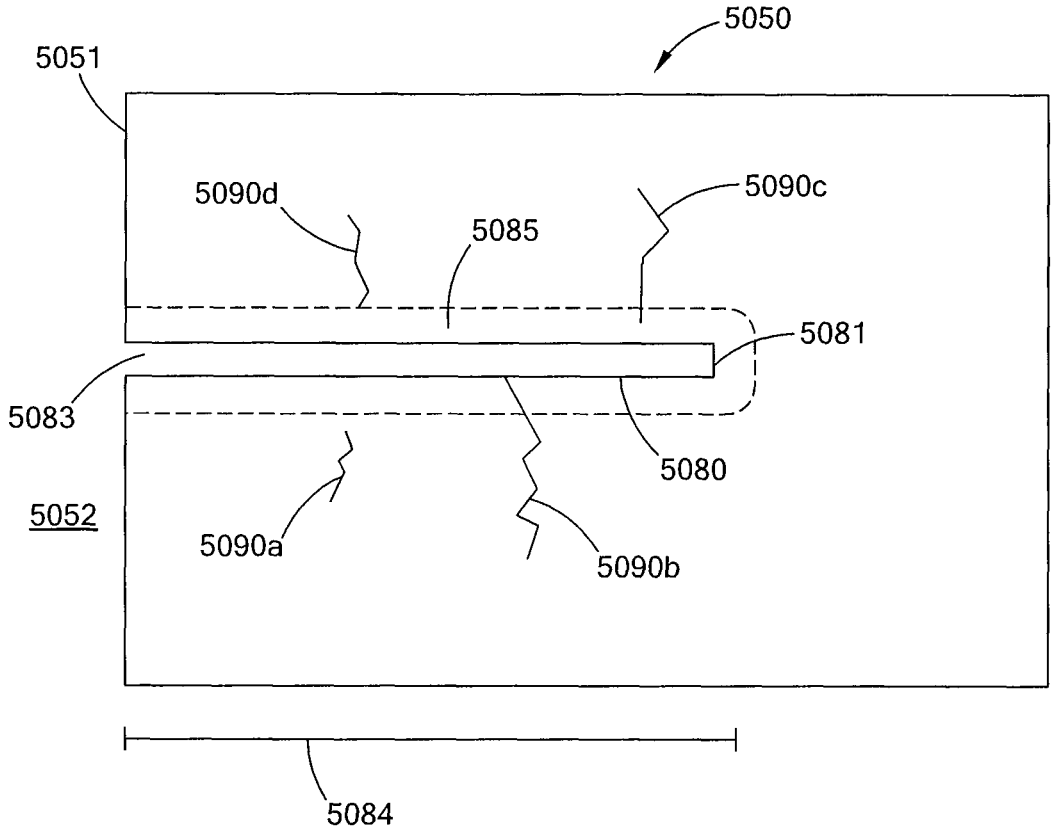
FIG. 5B is a perspective view of an embodiment of a laser energy delivery pattern in accordance with the present inventions.

Turning to FIGS. 5A and 5B there are shown in FIG. 5A a prospective view a section of a formation 5050, and in FIG. 5B a cross sectional view of the formation 5050. The formation 5050 is shown as being freestanding, e.g., a block of material, for the purpose of clarity in the figure. It being understood that the formation may be deep within the earth, nearer to the surface such as in some shale gas fields, and preferably in a hydrocarbon rich or pay zone of the formation, and that the face 5051 forms a part of, or is adjacent to, a borehole 5052 (as seen in FIG. 5B). Further although some boreholes are represented as being vertical, this is merely for illustration purposes and it should be recognized that the boreholes may have any orientation.

A laser cut hole 5080 extends into the formation 5050 from the hole opening 5083 to the back of the hole 5081. Around the hole 5080 is an area 5085 of laser affected formation. In this area 5085 the formation is weakened, substantially weakened, fractured or essentially structurally destroyed. Additionally, the laser cutting process forms cracks or fractures, i.e., laser induced fracturing, in the formation. By way of example, fracture 5090*a* is an independent fracture and does not extend to, or into, the laser affected area 5085, the hole 5080 or another fracture. Fracture 5090*b* extends into and through the laser affected area 5085 into the hole 5081. Additionally, fracture 5090*b* is made up of two associated cracks that are not fully connected. Fracture 5090*c* extends to, and into, the laser affected area 5085 but does not extend to the hole 5080. Fracture 5090*d* extend to, but not into the laser affected area 5085.

The fractures 5090*a*, 5090*b*, 5090*c* and 5090*d* are merely schematic representation of the laser induced fractures that can occur in the formation, such as rock, earth, rock layer formations and hard rocks, including for example granite, basalt, sandstone, dolomite, sand, salt, limestone and shale rock. In the formation, and especially in formations that have a tendency, and a high tendency for thermal-mechanical fracturing, in a 10 foot section of laser cut hole there may be about 10, about 20, about 50 or more such fractures, and these fractures may be tortious, substantially linear, e.g., such as a crack along a fracture line, interconnected to greater and lessor extents, and combinations and variations of these. These laser fractures may also be of varying size, e.g., length, diameter, or distance of separation. Thus, they may vary from micro fractures, to hairline fractures, to total and extended separation of sections having considerable lengths.

The depth or length of the hole can be controlled by determining the rate, e.g., inches/min, at which the hole is advanced for a particular laser beam, configuration with respect to the work surface of the formation, and type of formation. Thus, based upon the advancement rate, the depth of the hole can be predetermined by firing the laser for a preset time.

The rate and extent of the laser fracturing, e.g., laser induced crack propagation, may be monitored by sensing and monitoring devices, such as acoustical devices, acoustical geological sensing devices, and other types of geological, sensing and surveying type devices. In this manner the rate and extent of the laser fracturing may be controlled real time, by adjusting the laser beam properties based upon the sensing data.

Cuts in, sectioning of, and the volumetric removal of the formation down hole can be accomplished by delivering the laser beam energy to the formation in preselected and predetermined energy distribution patterns. These patterns can be done with a single laser beam, or with multiple laser beams. For example, these patterns can be: a linear cut; a pie shaped cut; a cut appearing like the shape of an automobile cam shaft; a circular cut; an elepitcal cut; a square cut; a spiral cut; a pattern of connected cuts; a pattern of connected linear cuts, a pattern of radially extending cuts, e.g., spokes on a wheel; a circle and radial cut pattern, e.g., cutting pieces of a pie; a pattern of spaced apart holes, such as in a line, in a circle, in a spiral, or other pattern, as well as other patterns and arrangements. The patterns, whether lines, staggered holes, others, or combinations thereof, can be traced along, e.g., specifically targeted in a predetermined manner, a feature of the formation, such as, a geologic joints, bedding layers, or other naturally occurring features of a formation that may enhance, exploited or built upon to increase the fluid connectivity between the borehole and the hydrocarbons in the formation.

Thus, for example, in determining a laser beam delivery pattern to provide a predetermined and preselected laser beam energy distribution pattern, the spacing of cut lines, or staggered holes, in the formation, preferably may be such that the laser affect zones are slightly removed from one another, adjacent to one another but do not overlap, or overlap only slightly. In this manner, the maximum volume of the formation will be laser affect, i.e., weakened, fractured or perforated with the minimum amount of total energy.

Laser perforating tools and operations may find considerable uses in shales and shale formations and other unconventional or difficult to produce from formations. For example, in shales for unconventional extraction of gas and oil there is no permeability. The current operations to access this rock and make it productive are to drill a 6 to 12 inch diameter borehole, thousands of feet long with a mechanical rig and bit, and then perforate on the order of inches using explosives. Once the perforations are formed thousands of gallons of high pressure fluid and proppant are used to open the pores to increase permeability.

The high power laser perforating tools can greatly improve on the conventional operation by creating a custom geometry (e.g. shape, length, entrance area, thickness) with a laser. This custom geometry can stem off a main borehole in any orientation and direction, which in turn will initiate a fracture that is more productive than existing conventional methods, by exposing more rock and positioning the fractures in optimum stress planes.

Generally, fracturing in rocks at depth is suppressed by the confining pressure, from the weight of the rocks and earth above. The force of the overlying rocks is particularly suppressive of fracturing in the situation of tensile fractures, e.g., Mode 1 fractures. These fractures require the walls of the fracture to move apart, working against this confining pressure.

Hydraulic fracturing or fracing is used to increase the fluid communication between the borehole and the formation. Thus, it can restore, maintain, and increase the rate at which fluids, such as petroleum, water, and natural gas are produced from reservoirs in formations.

Thus, it has long been desirable to create conductive fractures in the rock, which can be pivotal to extract gas from shale reservoirs because of the extremely low natural permeability of shale, which is measured in the microdarcy to nanodarcy range. These fractures provide a conductive path connecting a larger volume of the reservoir to the borehole.

The custom geometry that can be created with laser perforating can provide enhanced, more predictable, and more controllable predetermined conductive paths that result from hydrofacturing. Thus, the laser perforation custom geometry can increase the efficiency of hydraulic fracturing and hydrocarbon production from a well.

Laser perforated custom geometris for hydrofracing has many advantages in all well types, and particularly has and advantages in horizontal drilling, which involves wellbores where the borehole is completed as a "lateral" that extends parallel to the hydrocarbon containing rock layer. For example, lateral boreholes can extend 1,500 to 5,000 feet (460 to 1,500 m) in the Barnett Shale basin in Texas, and up to 10,000 feet (3,000 m) in the Bakken formation in North Dakota. In contrast, a vertical well only accesses the thickness of the rock layer, typically 50-300 feet (15-91 m). Mechanical drilling, however, typically causes damage to the pore space, e.g., formation structure, at the wellbore wall, reducing the permeability at and near the wellbore. This reduces flow into the borehole from the surrounding rock formation, and partially seals off the borehole from the surrounding rock. Custom geometries, from the laser perforation, enable hydraulic fracturing in these wells to restore and potentially increase permeability and the productivity of the well.

Thus, the laser perforating tools, and laser energy distribution patterns, which can provide custom geometries for hydrofacting operations, have the potential to greatly increase hydrocarbon production, especially form unconventional sources.

Turning to FIG. 6A to 6D there is shown an embodiment of an adjustable optics package that may be used in a laser cutting tool. FIG. 6 is a perspective view of the adjustable optics package 6024 with a laser beam 6027 being propagated, e.g., fired, shot, delivered, from the front (distal) end 6025 of the optics package 6024. The optics package 6025 has an adjustment body 6028 that has a fixed ring 6029. The adjustment body 6028 is adjustably, e.g., movably, associated with the main body 6031 of the optics package 6024, by threaded members. There is also a locking ring 6032 on the adjustment body 6028. The locking ring 6029 is engageable against the main body to lock the adjustment body 6028 into position.

Figure 6A:
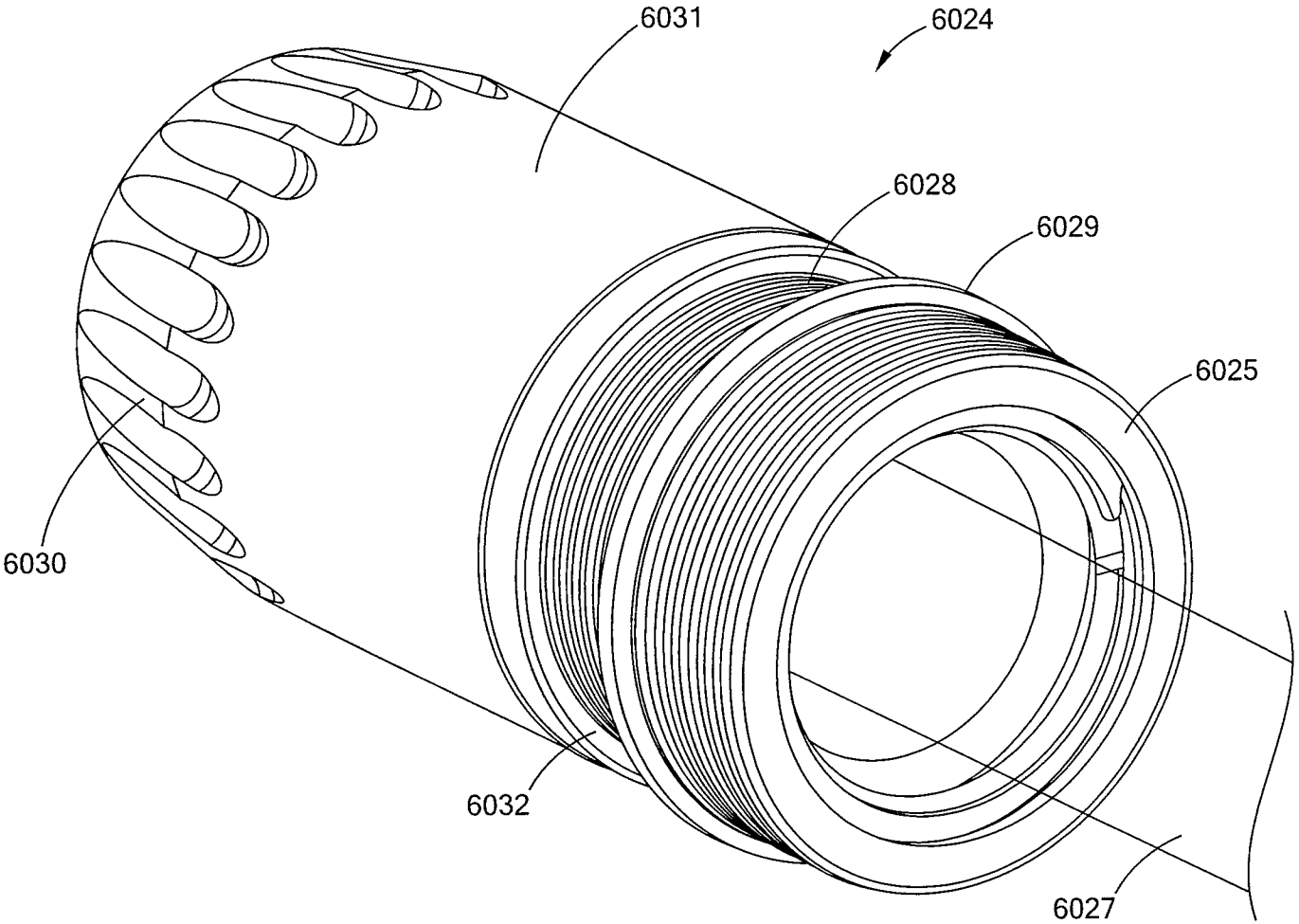
FIG. 6A is a perspective view of an embodiment of an optics assembly in accordance with the present inventions.
Figure 6B:
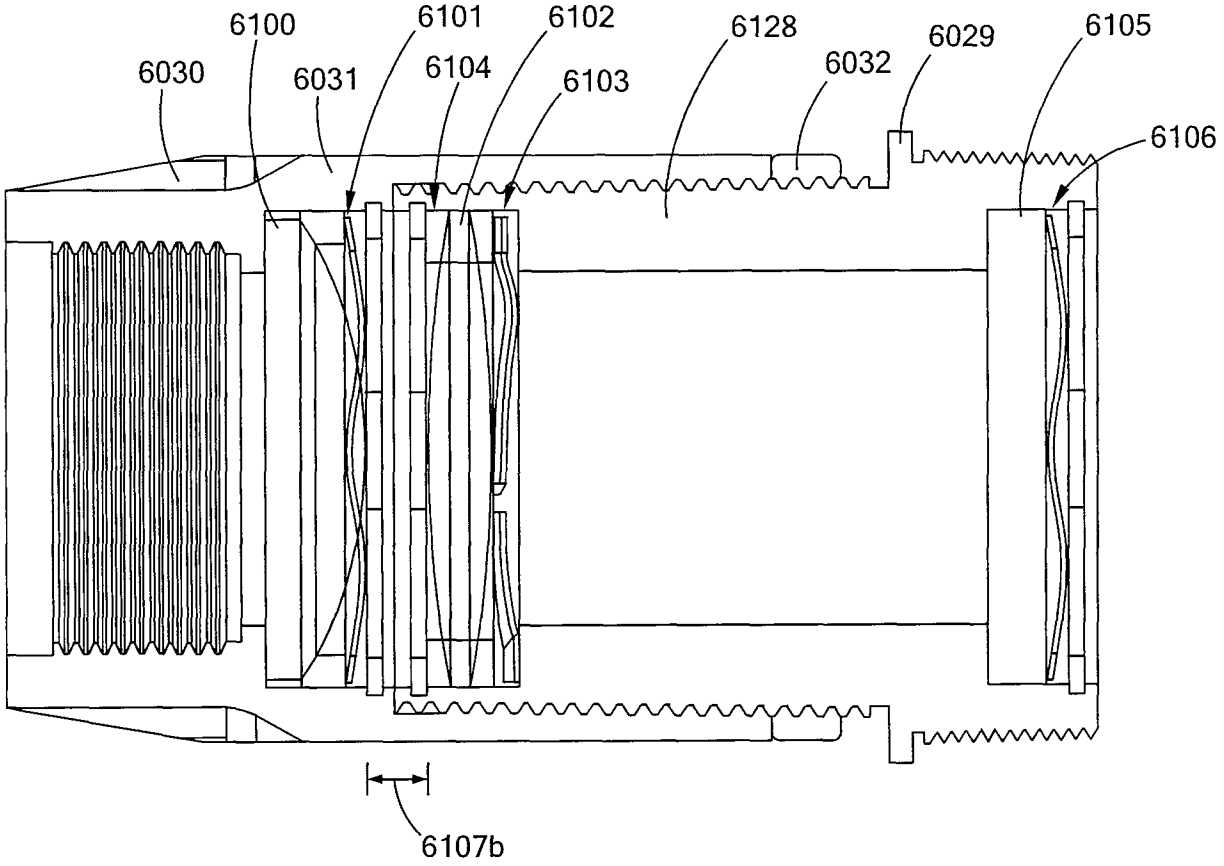
FIG. 6B is a cross sectional view of the embodiment of FIG. 6A.
Figure 6C:
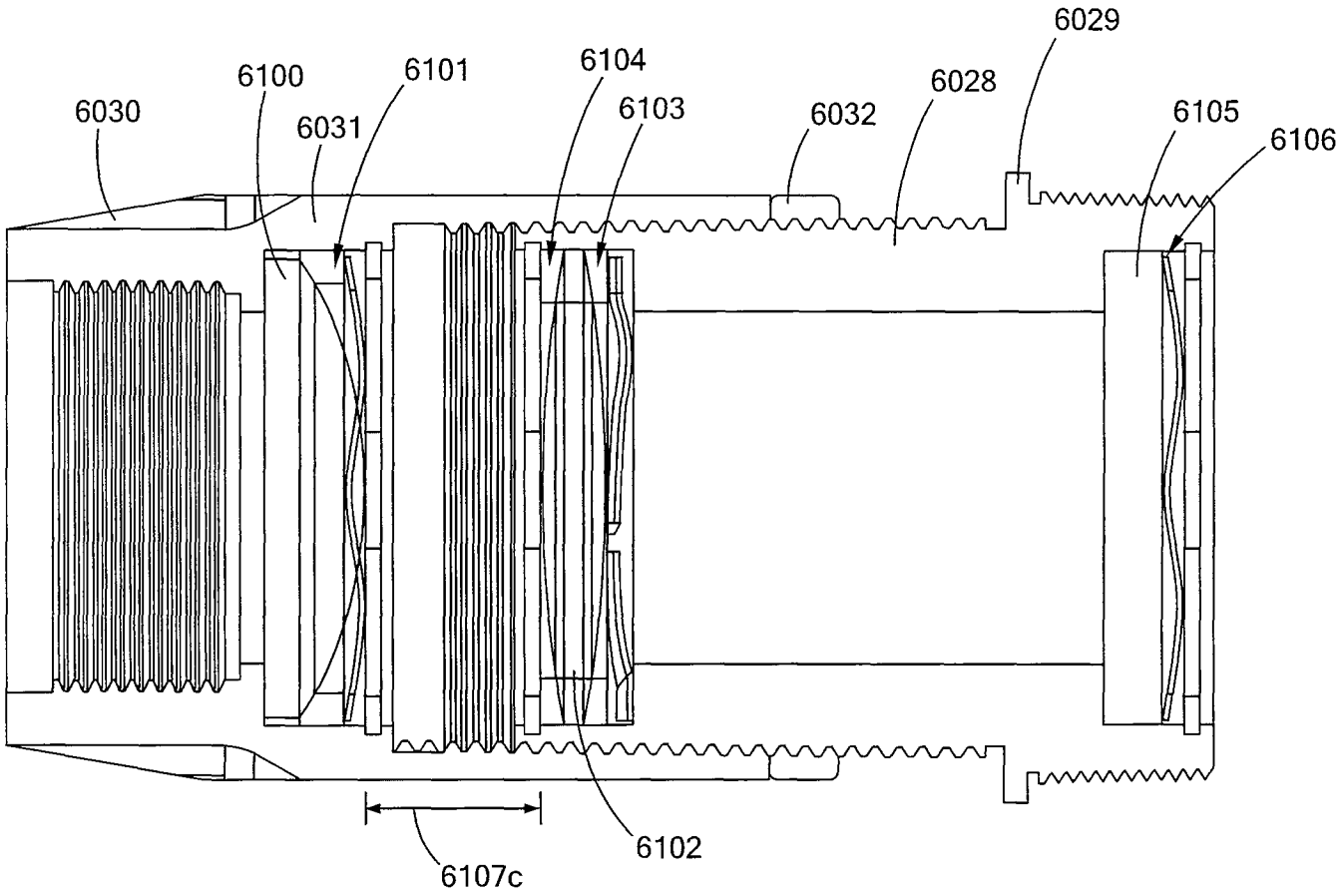
FIG. 6C is a cross sectional view of the embodiment of FIG. 6A.
Figure 6D:
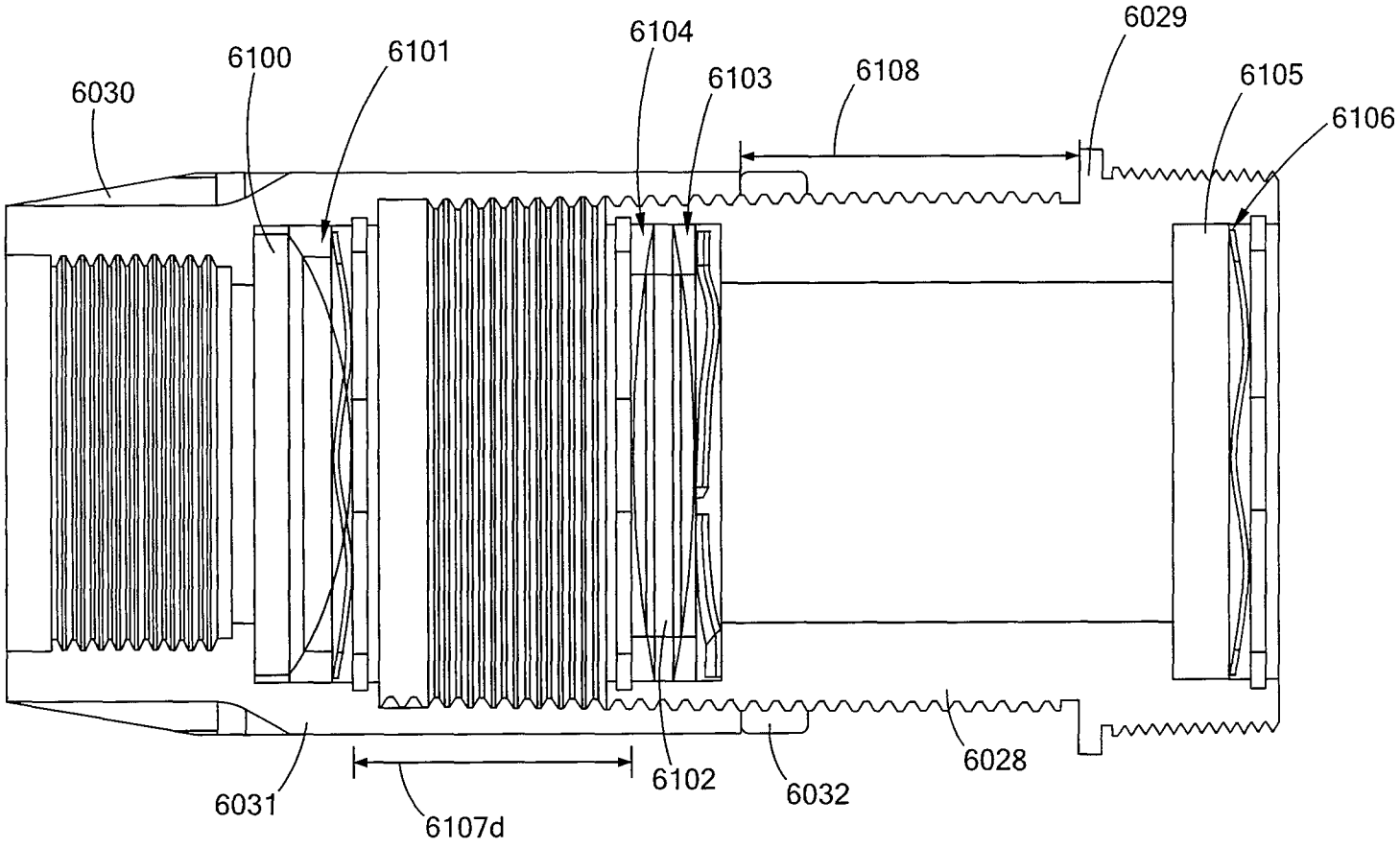
FIG. 6D is a cross sectional view of the embodiment of FIG. 6A.

Turning to FIGS. 6B to 6D, there are shown cross sectional views of the embodiment of FIG. 6A in different adjustment positions. Thus, there is provided a first focusing lens 6100, which is held in place in the main body 6031 by lens holding assembly 6101. Thus, lens 6100 is fixed, and does not change position relative to main body 6031. A second focusing lens 6102 is held in place in the adjustment body 6028 buy holding assemblies 6103, 6104. Thus, lens 6102 is fixed, and does not change position relative to the adjustment body 6028. Window 6105 is held in place in the front end 6025 of the adjustment body 6028 by holding assembly 6106. In this manner as the adjustment body 6028 is moved in and out of the main body 6031 the distance, e.g., 6107*b*, 6107*c*, 6107*d*, between the two lens 6100, 6102 changes resulting in the changing of the focal length of the optical system of the optics package 6024. Thus, the optical system of optics package 6024 can be viewed as a compound optical system.

In FIG. 6B the two lenses 6100, 6102 are at their closest position, i.e., the distance 6107*b* is at its minimum. In FIG. 6C the two lenses 6101,6102 are at a middle distance, i.e., the distance 6107*c* is at about the mid point between the minimum distance and the maximum distance. In FIG. 6D the two lenses 6101, 6102 are at their furthest operational distance, i.e., the distance 6107*d* is the maximum distance that can operationally be active in the optics assembly. (It should be noted that although the adjustment body 6028 could be moved out a little further, e.g., there are a few threads remaining, to do so could compromise the alignment of the lenses, and thus, could be disadvantages to the performance of the optics package 6024.)

Figure 7:
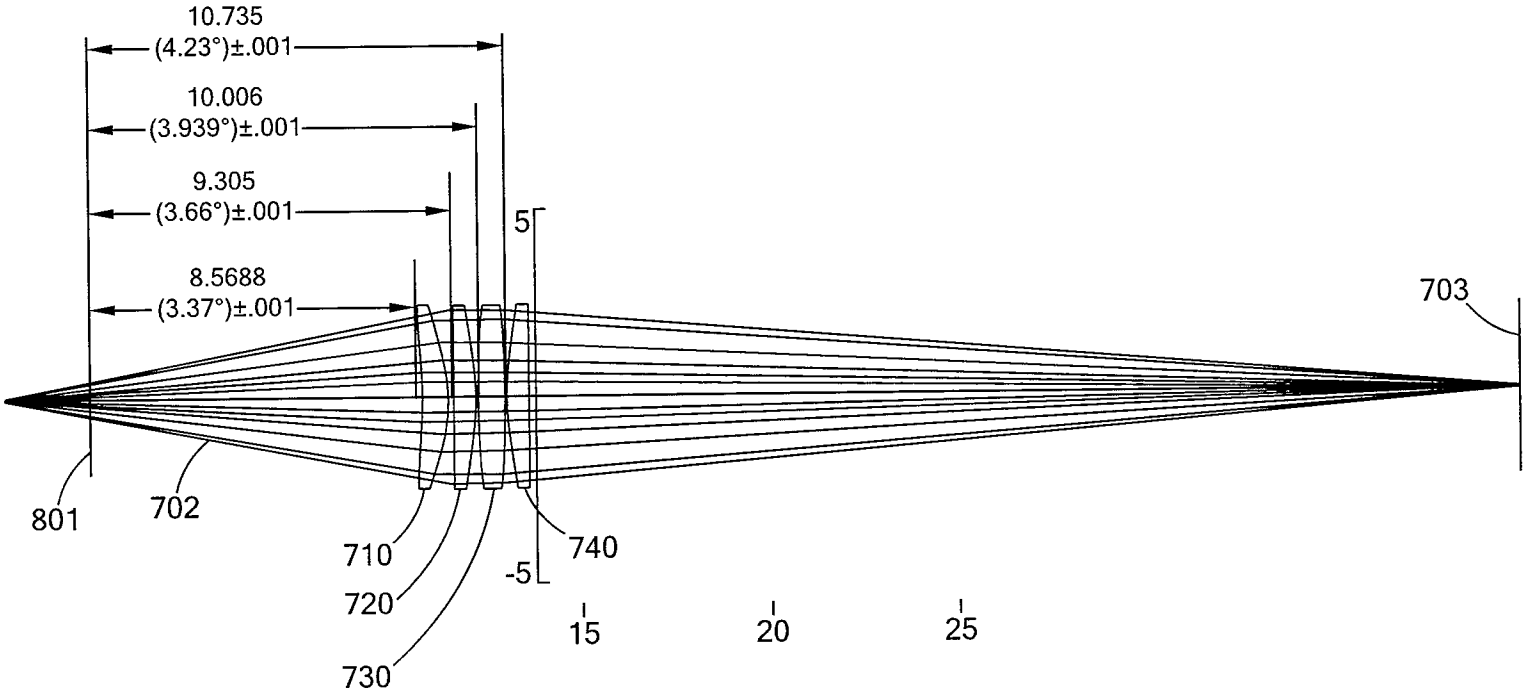
FIG. 7 is a schematic of an embodiment of an optical configuration in accordance with the present inventions.

Turning to FIG. 7, there is shown a schematic of an embodiment of an optical assembly for use in an optics package, having a launch face 701 from a connector, ray trace lines 702 show the laser beam exiting the face of the connector and traveling through four lens, lens 710, lens 720, lens 730, lens 740. In this embodiment lens 710 minimizes the aberrations for the lens 710-720 combination, which combination collimates the beam. Lens 730 and 740 are the focusing lenses, which focus the laser beam to a focal point on focal plane 703. Lens 740 minimizes the spherical aberrations of the 730-740 lens pair.

Differing types of lens may be used, for example in an embodiment Lens 730 has a focal length of 500 mm and lens 740 has a focal length of 500 mm, which provide for a focal length for the optics assembly of 250 mm. The NA of the connector face is 0.22. Lens 710 is a meniscus (f=200 mm). Lens 720 is a plano-convex (f=200 mm). Lens 730 is a plano-convex (f=500 mm). Lens 740 is a menisus (f=500 mm). In another embodiment only one focusing lens is used, lens 740. Lens 730 has been removed from the optical path. As such, the focal length for the beam provided by this embodiment is 500 mm. In a further embodiment, lens 730 has a 1,000 mm focus and a diameter of 50.8 mm and lens 740 is not present in the configuration, all other lens and positions remain unchanged, providing for an optical assembly that has a focal length of 1,000 mm.

Figure 8A:
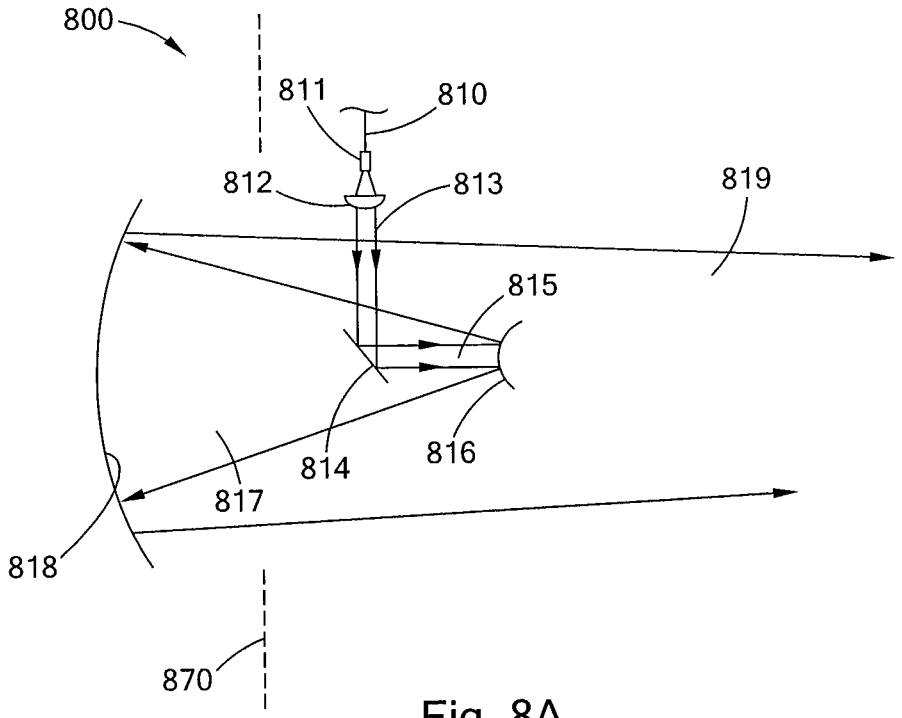
FIG. 8A is a schematic side view of an embodiment of an optical configuration in accordance with the present inventions.
Figure 8B:
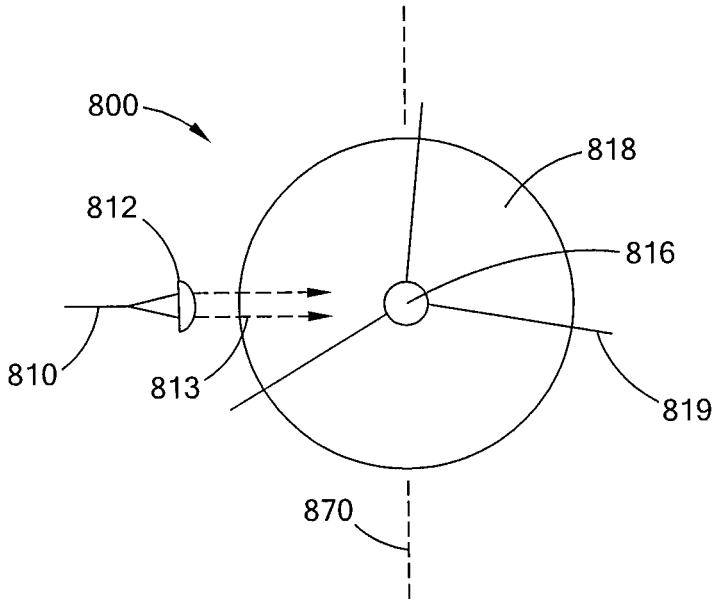
FIG. 8B is a schematic plan view of the embodiment of FIG. 8A.

Turning to FIGS. 8A and 8B there is shown an embodiment of a divergent, convergent lens optics assembly for providing a high power laser beam for creating perforation holes having depths, e.g., distances from the primary borehole, of greater than 10 feet, greater than about 20 feet, greater than about 50 feet, and greater than 100 feet.

FIG. 8A provides a side view of this optics assembly 800, with respect to the longitudinal axis 870 of the tool. FIG. 8B provides a front view of optics assembly 800 looking down the longitudinal axis 870 of the tool. As best seen in FIG. 8A, where there is shown a side schematic view of an optics assembly having a fiber 810 with a connector 811 launch a beam into a collimating lens 812. The collimating optic 812 directs the collimated laser beam along beam path 813 toward reflective element 814, which is a 45° mirror assembly. Reflective mirror 814 directs the collimated laser beam along beam path 815 to diverging mirror 816. Diverging mirror 816 directs the laser beam along diverging beam path 817 where it strikes primary and long distance focusing mirror 818. Primary mirror focuses and directs the laser beam a long perforating laser path 829 toward the casing, cement and/or formation (not shown) to be perforated. Thus, the two mirrors 816, 818, have their reflective surfaces facing each other. The diverging (or secondary) mirror 816 supports 819 are seen in FIG. 8B.

In an example of an embodiment of this optical assembly, the fiber may have a core of about 200 μm, and the NA of the connector 811 distal face is 0.22. The beam launch assembly (fiber 810/connector 811) launches a high power laser beam, having 20 kW of power in a pattern shown by the ray trace lines, to a secondary mirror 816. The diverging mirror 816 is located 11 cm (as measured along the total length of the beam path) from the launch or distal face of the beam launch assembly. The secondary mirror has a diameter of 2" and a radius of curvature 143 cm. For distances of about 100 feet the primary mirror 818 has a diameter of 18" and a radius of curvature of 135 cm. In this embodiment the primary mirror is shaped, based upon the incoming beam profile, to provide for a focal point 100 feet from the face the primary mirror. This configuration can provided a very tight spot in the focal plain, the spot having a diameter of 1.15 cm. Moving in either direction from the focal plane, along the beam waist, for about 4 feet in either direction (e.g., an 8 foot optimal cutting length of the laser beam) the laser beam spot size is about 2 cm. For cutting rock, it is preferable to have a spot size of about ¾" or less (1.91 cm or less) in diameter (for laser beam having from about 10 to 40 kW). In an example of an embodiment during use, the diverging mirror could have 2 kW/cm$^2$ and the primary mirror could have 32 W/cm$^2$ of laser power on their surfaces when performing a laser perforation operation.

Figure 9:
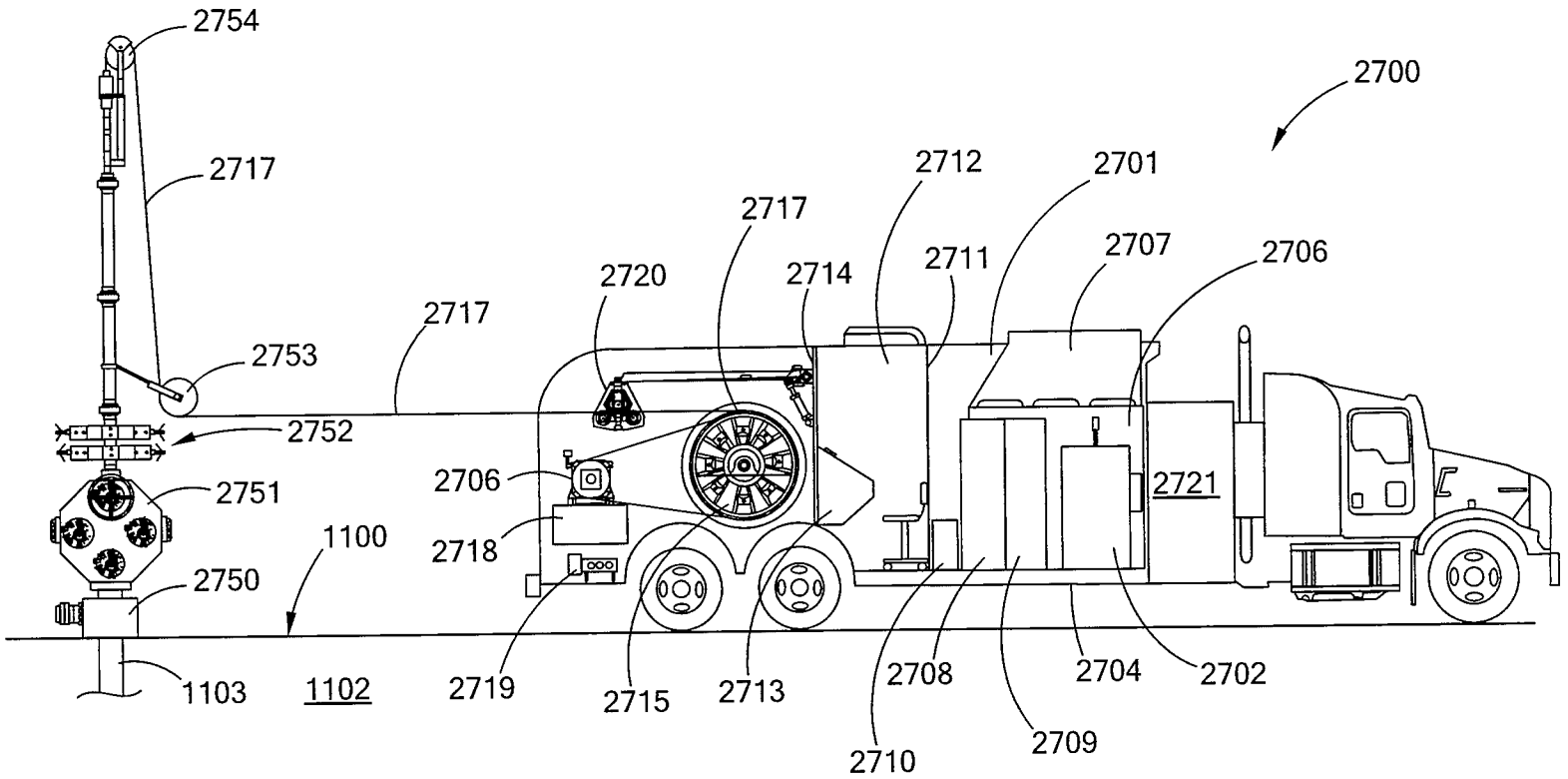
FIG. 9 is a schematic view of an embodiment of a mobile laser system in accordance with the present inventions.
Figure 10:
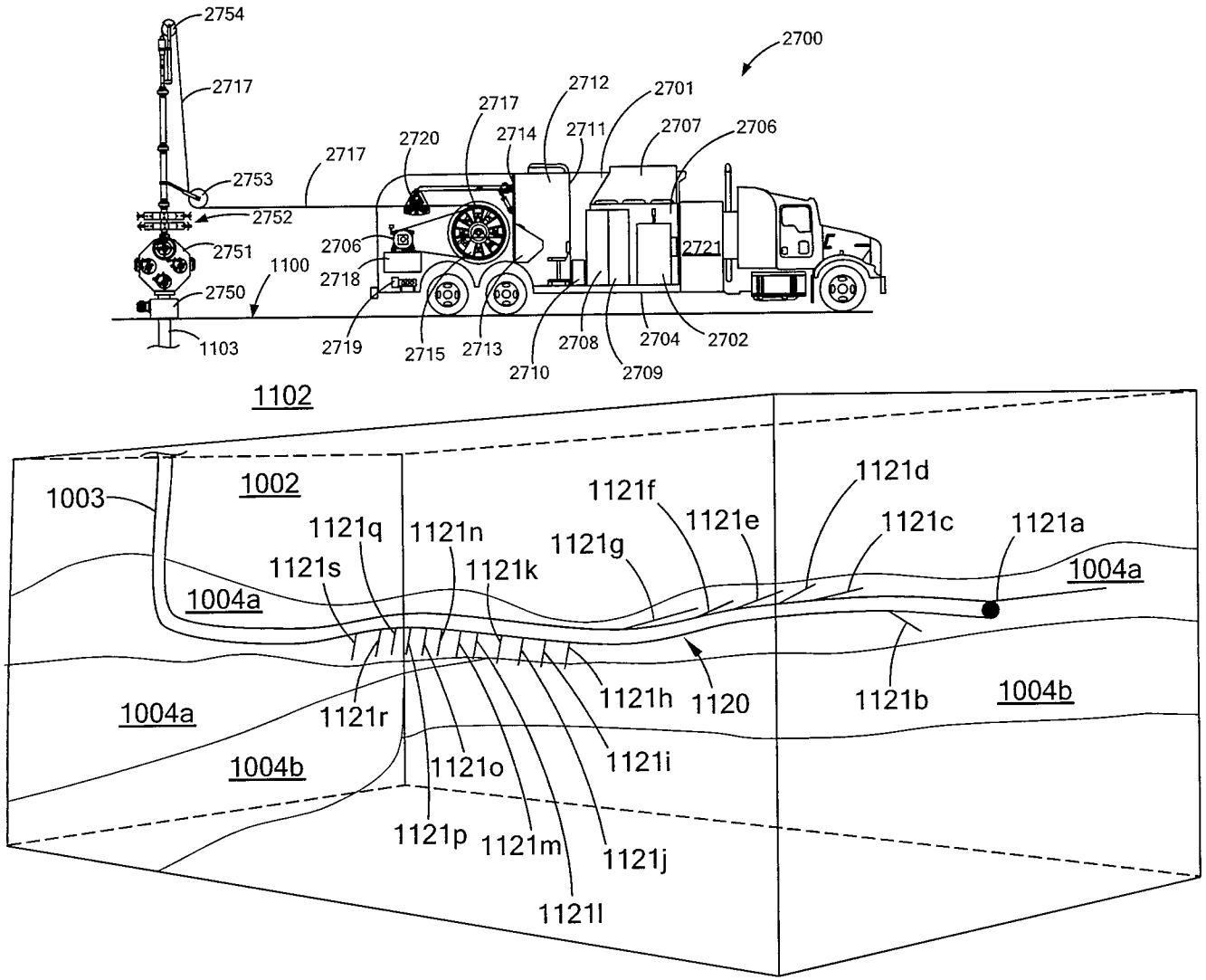
FIG. 10 is a perspective view of an embodiment of laser system providing an embodiment of a laser energy delivery pattern in accordance with the present inventions.

An embodiment of a high power laser system and its deployment and use in the field, to provide a custom laser perforation and fracturing pattern to a formation, is shown in FIGS. 9 and 10. Thus, there is provided a mobile laser conveyance truck (MLCT) 2700. The MLCT 2700 has a laser cabin 2701 and a handling apparatus cabin 2703, which is adjacent the laser cabin. The laser cabin 2701 and the handling cabin 2703 are located on a truck chassis 2704.

The laser cabin 2701 houses a high power fiber laser 2702, (20 kW; wavelength of 1070-1080 nm); a chiller assembly 2706, which has an air management system 2707 to vent air to the outside of the laser cabin and to bring fresh air in (not shown in the drawing) to the chiller 2706. The laser cabin also has two holding tanks 2708, 2709. These tanks are used to hold fluids needed for the operation of the laser and the chiller during down time and transit. The tanks have heating units to control the temperature of the tank and in particular to prevent the contents from freezing, if power or the heating and cooling system for the laser cabin was not operating. A control system 2710 for the laser and related components is provided in the laser cabin 2703. A partition 2711 separates the interior of the laser cabin from the operator booth 2712.

The operator booth contains a control panel and control system 2713 for operating the laser, the handling apparatus, and other components of the system. The operator booth 2712 is separated from the handling apparatus cabin 2703 by partition 2714.

The handling apparatus cabin 2703 contains a spool 2715 (about 6 ft OD, barrel or axle OD of about 3 feet, and a width of about 6 feet) holding about 10,000 feet of the conveyance structure 2717. The spool 2715 has a motor drive assembly 2716 that rotates the spool. The spool has a holding tank 2718 for fluids that may be used with a laser tool or otherwise pumped through the conveyance structure and has a valve assembly for receiving high pressure gas or liquids for flowing through the conveyance structure.

The laser 2702 is optically associated with the conveyance structure 2717 on the spool 2715 by way of an optical fiber and optical slip ring (not shown in the figures). The fluid tank 2718 and the valve assembly 2719 are in fluid communication with the conveyance structure 2717 on the spool 2715 by way of a rotary slip ring (not shown).

The laser cabin 2710 and handling apparatus cabin 2703 have access doors or panels (not shown in the figures) for access to the components and equipment, to for example permit repair, replacement and servicing. At the back of the handling apparatus cabin 2703 there are door(s) (not shown in the figure) that open during deployment for the conveyance structure to be taken off the spool. The MLCT 2700 has an electrical generator 2721 to provide electrical power to the system.

The MLCT 2700 is on the surface 100 of the earth 102, positioned near a wellhead 2750 of a borehole 103, and having a Christmas tree 2751, a BOP 2752 and a lubricator 2705. The conveyance structure 2717 travels through winder 2729 (e.g., line guide, level wind) to a first sheave 2753, to a second sheave 2754, which has a weight sensor 2755 associated with it. Sheaves 2753, 2754 make up an optical block.

The weight sensor 2755 may be associated with sheave 2753 or the composite structure 2717. The conveyance structure 2717 enters into the top of the lubricator and is advanced through the BOP 2752, tree 2751 and wellhead 2750 into the borehole (not shown) below the surface of the earth 2756. The sheaves 2753, 2754 have a diameter of about 3 feet. In this deployment path for the conveyance structure the conveyance structure passes through several radii of curvature, e.g., the spool and the first and second sheaves. These radii are all equal to or large than the minimum bend radius of the high power optical fiber in the conveyance structure. Thus, the conveyance structure deployment path would not exceed (i.e., have a bend that is tighter than the minimum radius of curvature) the minimum bend radius of the fiber.

Turning to FIG. 10 there is shown the MLCT 2700 over a prospective view a section of a formation 1104 in the earth 1102. The formation 1104 is shown as being freestanding, e.g., a block of material, for the purpose of clarity in the figure. It being understood that the formation may be deep within the earth, nearer to the surface such as in some shale gas fields and that the orientation of borehole 1103 may be from vertical, to the essentially horizontal shown in FIG. 10, to up turned, as well as branched.

The formation 1104 has various geological formations and properties, e.g., 1104*a*, 1104*b*, 1104*c*. The geological properties and characteristic of the formation and hydrocarbon deposit have been previously determined by seismic, well logging and other means known to the arts. Based upon this information a custom laser energy delivery perforating pattern 1120 was designed to extend from borehole 1103 and is delivered to the formation 1104. The laser perforating pattern 1120 has a series of laser perforations 1121*a*-1121*s*.

The position, spacing and orientation of these laser perforations 1121*a*-1121*s* is based in whole, or in part, upon the characteristics and features of the formation in which the laser pattern is delivered. As can be seen from FIG. 10, and for illustration purposes the perforation may have different lengths, may have different orientations to vertical, may have different angles with respect to the longitudinal axis of the borehole, and combinations and variations of these and other properties. Further, the perforation pattern and laser delivery pattern, because of its fracturing and weakening effect on the formation, may also be predetermined to enhance, augment, or replace hydraulic fracturing.

Figure 11:
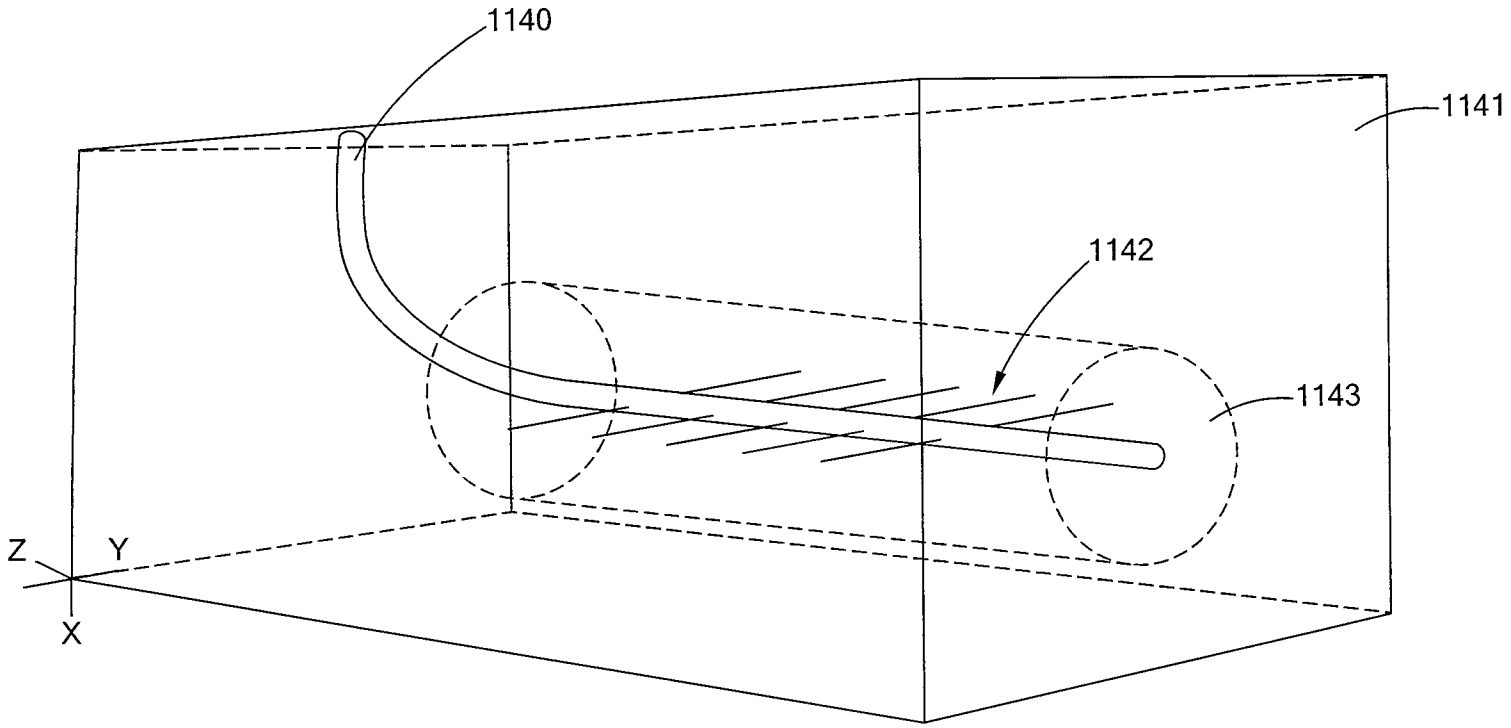
FIG. 11 is a perspective view of an embodiment of a laser energy delivery pattern in accordance with the present inventions.

Turning to FIG. 11 there is shown a bore hole 1140 in a section of a formation 1141. An essentially horizontal laser perforation pattern 1142 has been made from the borehole, resulting in a predetermined laser effected zone 1143, e.g., custom geometry (shown in dashed lines), which zone has laser induced fracturing. Hydraulicfracturing operations can then be applied to this custom geometry, if needed, to further enhance fluid communication between the borehole and the formation.

Figure 12:
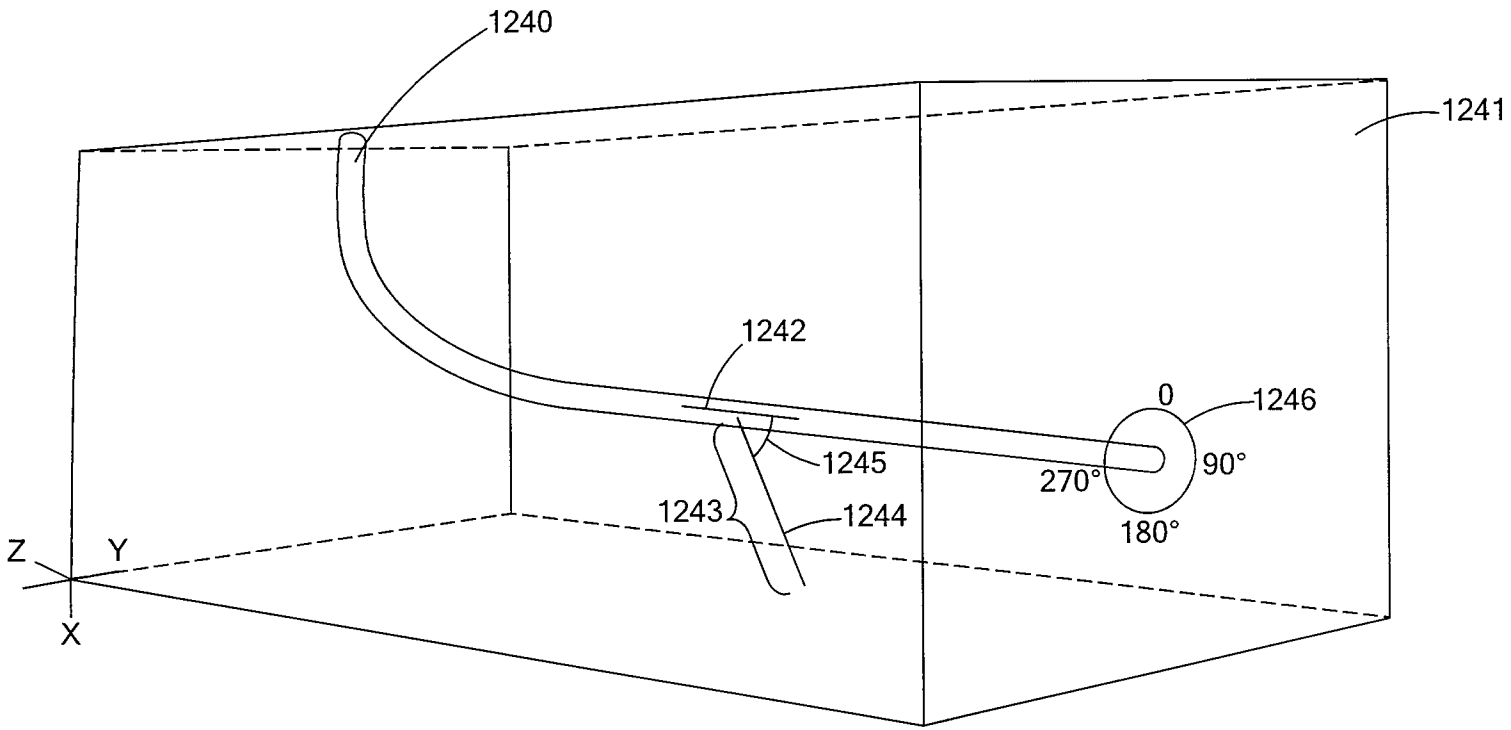
FIG. 12 is a perspective view of an embodiment of a laser energy delivery pattern in accordance with the present inventions.

FIG. 12 shows a borehole 1240 in a section of a formation 1241. The borehole has a single laser perforation 1244. A single perforation is used in this figure to illustrate the different variables that are controllable through laser perforation and which can, in whole or in part, be used to provide a predetermined laser perforation delivery pattern. The laser perforation can be varied in length 1243. The angle 1245 that the perforation forms with the longitudinal axis of the borehole (also typically the laser perforation tool) can be varied. The orientation around the borehole, e.g., degrees 1246 around the borehole can be varied, e.g., for 0° to 90° to 180° to 270° to 0°, and thus, any point around 360°. Additional, since it is preferred to have a multiple perforations, there spacing can be varied, and the other variables can be changed from one adjacent perforation to the next.

In additional to providing an entire laser perforation pattern based upon formation information, in whole, in part or without such information, it is possible to construct an evolving laser perforation pattern based upon real time pressure testing in the well. Thus, for example straddle packers may be employed with the laser perforation tool. The packers are set and the area is pressured up; changes, as measured with a caliper assembly for example, are then measured. From this information the strength of the formation and its strength in different directions can be measured and used to direct the laser beam to provide the optimum configuration of laser perforations for that specifically tested section of the formation.

Figure 13:
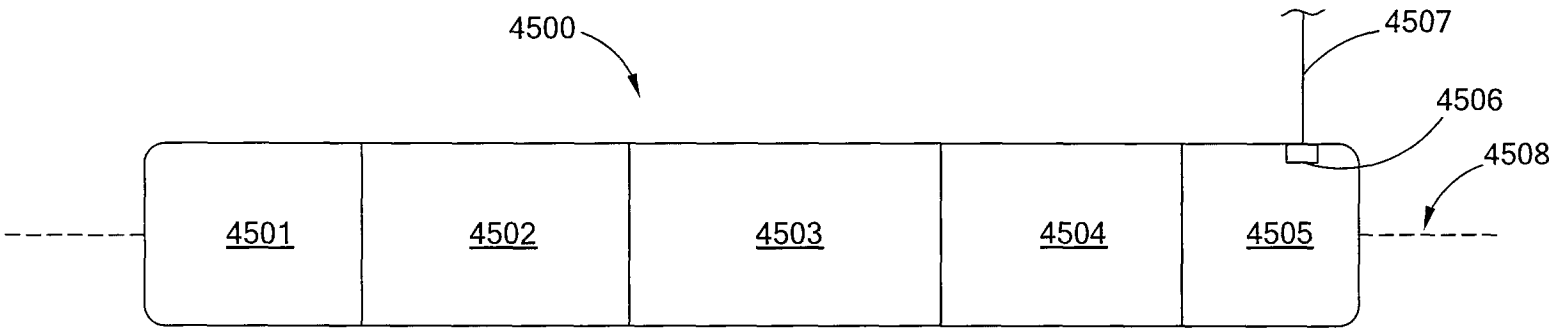
FIG. 13 is schematic view of an embodiment of a laser perforating tool in accordance with the present inventions.

Turning to FIG. 13 there is provided a schematic of an embodiment of a laser tool 4500 having a longitudinal axis shown by dashed line 4508. This tool could be used for, perforating as well as other things, such as pipe cutting, decommissioning, plugging and abandonment, window cutting, and milling. The laser cutting tool 4500 has a conveyance termination section 4501. The conveyance termination section 4501 would receive and hold, for example, a composite high power laser umbilical, a coil tube having for example a high power laser fiber and a channel for transmitting a fluid for the laser cutting head, a wireline having a high power fiber, or a slick line and high power fiber, or other type of conveyance structure. The laser tool 4500 has an anchor and positioning section 4502. The anchor and positioning section (which may be a single device or section, or may be separate devices within the same of different sections) may have a centralizer, a packer, or shoe and piston or other mechanical, electrical, magnetic or hydraulic device that can hold the tool in a fixed and predetermined position longitudinally (e.g., along the length of the borehole), axially (e.g., with respect to the axis of the borehole, or within the cross-section of the borehole) or both. The section may also be used to adjust and set the stand off distance that the laser head is from the surface to be perforated.

The laser tool 4500 has a motor section, which may be an electric motor, a step motor, a motor driven by a fluid, or other device to rotate the laser cutter head, or cause the laser beam path to rotate. The rotation of the laser tool, or laser head, may also be driven by the forces generated by the jet, either the laser fluid jet or a separate jet. For example, if the jet exits the tool at an angle or tangent to the tool it may cause rotation. In this configuration the laser fiber, and fluid path, if a fluid used in the laser head, passes by or through the motor section 4503. Motor, optic assemblies, and beam and fluid paths disclosed and taught in US Patent Application Publication No. 2012/0267168, the entire disclosure of which is incorporated herein by reference, may be utilized. There is provided an optics section 4504, which for example, may shape and direct the beam and have optical components such as a collimating element or lens and a focusing element or lens. Optics assemblies, packages and optical elements disclosed and taught in US Patent Application Publication No. 2012/0275159, the entire disclosure of which is incorporated herein by reference, may be utilized.

There is provided a laser cutting head section 4505, which directs and moves the laser beam along a laser beam path 4507. In this embodiment the laser cutting head 4505 has a laser beam exit 4506. In operation the laser beam path may be rotated through 360 degrees to perform a complete circumferential cut of a tubular. (The laser beam may also be simultaneously moved linearly and rotationally to form a spiral, s-curve, figure eight, or other more complex shaped cut.) The laser beam path 4507 may also be moved along the axis 4508 of the tool 4500. The laser beam path also may not be moved during propagation or delivery of the laser beam. In these manners, circular cuts, windows, perforations and other predetermined shapes may be made to a borehole (cased or open hole), a tubular, a support member, or a conductor. In the embodiment of FIG. 45, as well as some other embodiments, the laser beam path 4507 forms a 90-degree angle with the axis of the tool 4508. This angle could be greater than 90 degrees or less then 90 degrees.

The laser cutting head section 4505 preferably may have any of the laser fluid jet heads provided in this specification, it may have a laser beam delivery head that does not use a fluid jet, and it may have combinations of these and other laser delivery heads that are known to the art.

Figure 14:
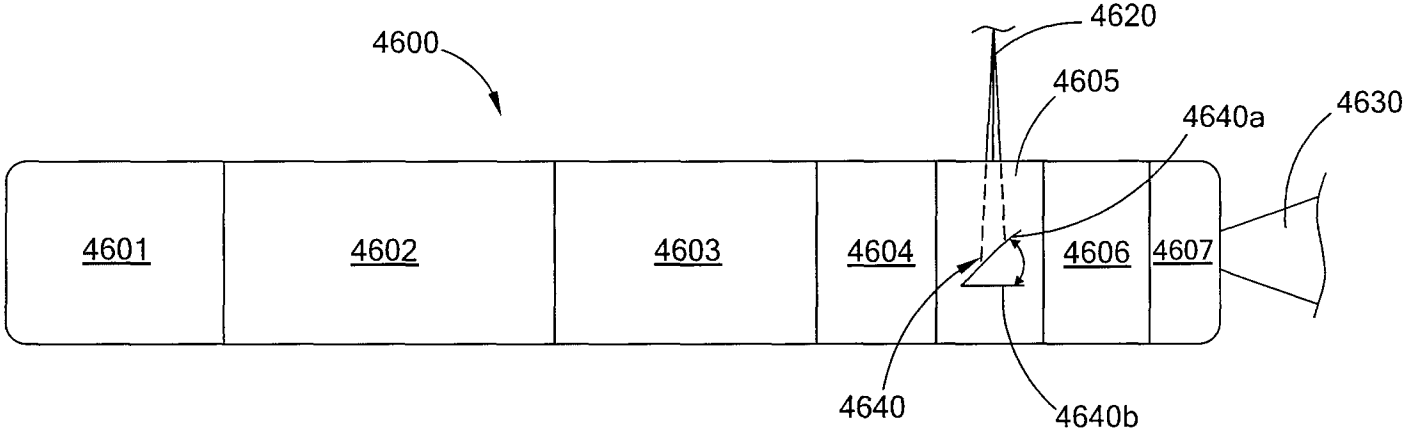
FIG. 14 is schematic view of an embodiment of a laser perforating tool in accordance with the present inventions.

Turning to FIG. 14, there is shown an embodiment of a laser perforating tool 4600. The laser cutting and perferating tool 4600 has a conveyance termination section 4601, an anchoring and positioning section 4602, a motor section 4603, an optics package 4604, an optics and laser cutting head section 4605, a second optics package 4606, and a second laser cutting head section 4607. The conveyance termination section would receive and hold, for example, a composite high power laser umbilical, a coil tube having for example a high power laser fiber and a channel for transmitting a fluid for the laser cutting head, a wireline having a high power fiber, or a slick line and high power fiber.

The anchor and positioning section may have a centralizer, a packer, or shoe and piston or other mechanical, electrical, magnetic or hydraulic device that can hold the tool in a fixed and predetermined position both longitudinally and axially. The section may also be used to adjust and set the stand off distance that the laser head is from the surface to be cut. The motor section may be an electric motor, a step motor, a motor driven by a fluid or other device to rotate one or both of the laser cutting heads or cause one or both of the laser beam paths to rotate.

The optics and laser cutting head section 4605 has a mirror 4640. The mirror 4640 is movable between a first position 4640*a*, in the laser beam path, and a second position 4640*b*, outside of the laser beam path. The mirror 4640 may be a focusing element. Thus, when the mirror is in the first position 4640*a*, it directs and focuses the laser beam along beam path 4620. When the mirror is in the second position 4640*b*, the laser beam passes by the mirror and enters into the second optics section 4606, where it may be preferably shaped into a larger circular spot (having a diameter greater than the tools diameter), or a substantially linear or elongated eliptical pattern, for delivery along beam path 4630. Two fibers and optics assemblies may used, a beam splitter within the tool, or other means to provide the two laser beam paths 4620, 4630 may be used.

The tool of the FIG. 14 embodiment may be used in addition to perforing, for example, in the boring, sidetracking, window milling, rat hole formation, radially cutting, and sectioning operations, wherein beam path 4630 would be used for boring and beam path 4620 would be used for the axial cutting, perforating and segmenting of the structure. Thus, the beam path 4620 could be used to cut a window in a cased borehole and the formation behind the casing. A whipstock, or other off setting device, could be used to direct the tool into the window where the beam path 4630 would be used to form a rat hole; or depending upon the configuration of the laser head 4607, e.g., if it where a laser mechanical bit, continue to advance the borehole. Like the embodiment of FIG. 14, the laser beam path 4620 may be rotated and moved axially. The laser beam path 4630 may also be rotated and preferably should be rotated if the beam pattern is other than circular and the tool is being used for boring. The embodiment of FIG. 46 may also be used to clear, pierce, cut, or remove junk or other obstructions from the bore hole to, for example, facilitate the pumping and placement of cement plugs during the plugging of a bore hole.

The laser head section 4607 preferably may have any of the laser fluid jet heads provided in this specification and in US Published Application Publication No. 2012/0074110, the entire disclosure of which is incorporated herein by reference, it may have a laser beam delivery head that does not use a fluid jet, and it may have combinations of these and other laser delivery heads that are known to the art.

Figure 15:
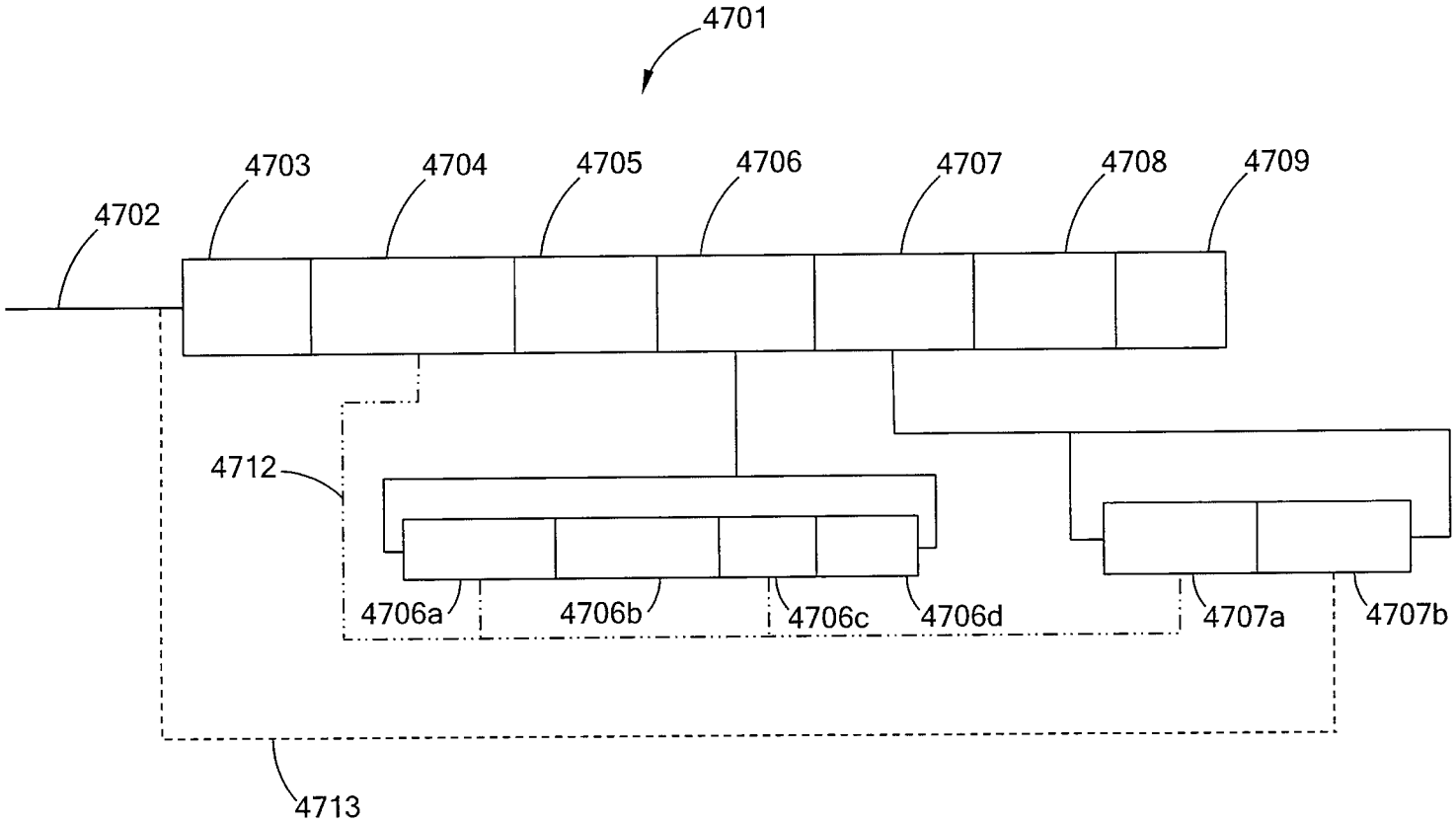
FIG. 15 is schematic view of an embodiment of a laser perforating tool in accordance with the present inventions.

Turning to FIG. 15 there is provided a schematic of an embodiment of a laser tool. The laser tool 4701 has a conveyance structure 4702, which may have an E-line, a high power laser fiber, and an air pathway. The conveyance structure 4702 connects to the cable/tube termination section 4703. The tool 4701 also has an electronics cartridge 4704, an anchor section 4705, an hydraulic section 4706, an optics/cutting section (e.g., optics and laser head) 4707, a second or lower anchor section 4708, and a lower head 4709. The electronics cartridge 4704 may have a communications point with the tool for providing data transmission from sensors in the tool to the surface, for data processing from sensors, from control signals or both, and for receiving control signals or control information from the surface for operating the tool or the tools components. The anchor sections 4705, 4708 may be, for example, a hydraulically activated mechanism that contacts and applies force to the borehole. The lower head section 4709 may include a junk collection device, or a sensor package or other down hole equipment. The hydraulic section 4706 has an electric motor 4706*a*, a hydraulic pump 4606*b*, a hydraulic block 4706*c*, and an anchoring reservoir 4706*d*. The optics/cutting section 4707 has a swivel motor 4707*a* and a laser head section 4707*b*. Further, the motors 4704*a* and 4706*a* may be a single motor that has power transmitted to each section by shafts, which are controlled by a switch or clutch mechanism. The flow path for the gas to form the fluid jet is schematically shown by line 4713. The path for electrical power is schematically shown by line 4712. The laser head section 4707*b* preferably may have any of the laser fluid jet heads provided in this specification, it may have a laser beam delivery head that does not use a fluid jet, and it may have combinations of these and other laser delivery heads that are known to the art.

Figure 17A:
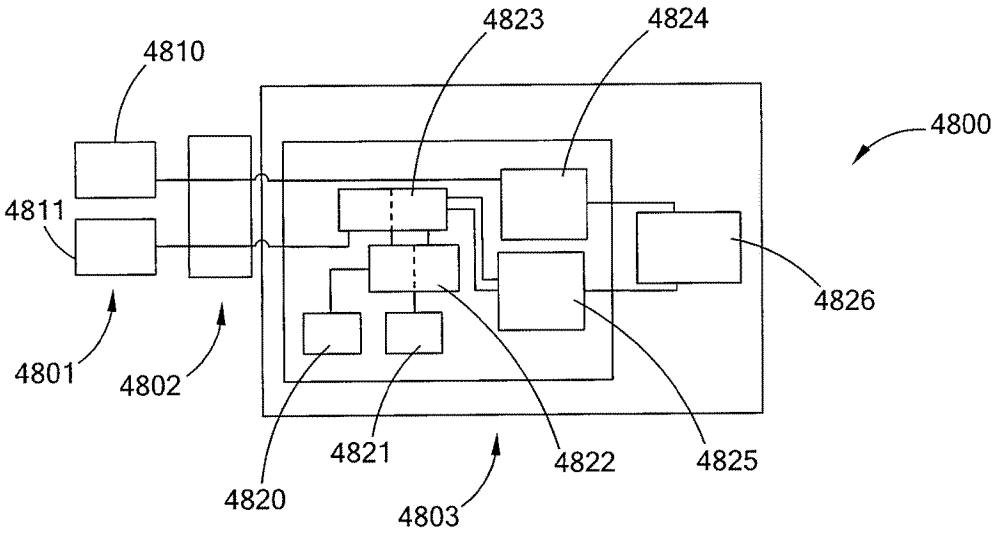
FIG. 17A is schematic view of an embodiment of a laser perforating tool in accordance with the present inventions.
Figure 17B:
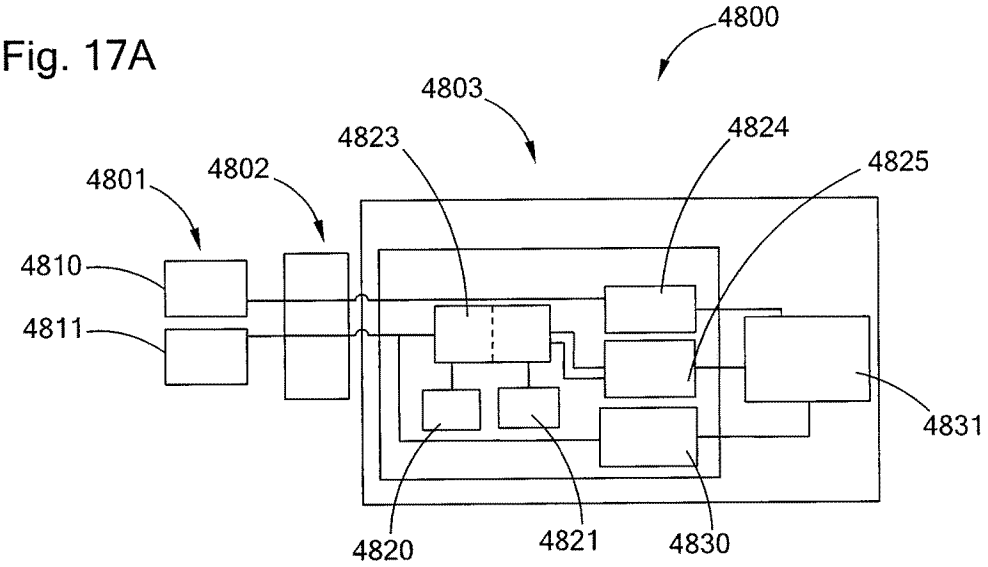
FIG. 17B is schematic view of an embodiment of a laser perforating tool in accordance with the present inventions.
Figure 18A:
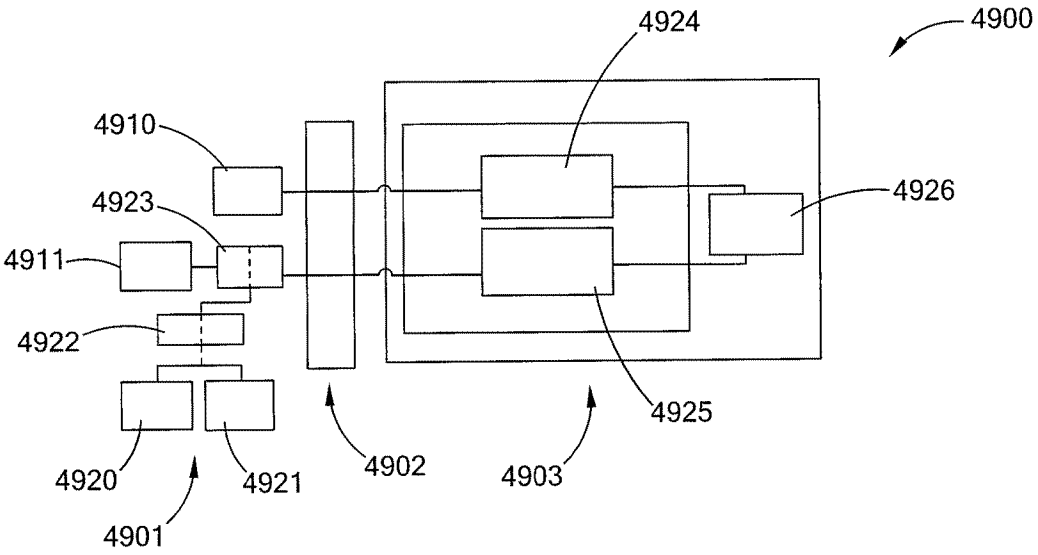
FIG. 18A is schematic view of an embodiment of a laser perforating tool in accordance with the present inventions.
Figure 18B:
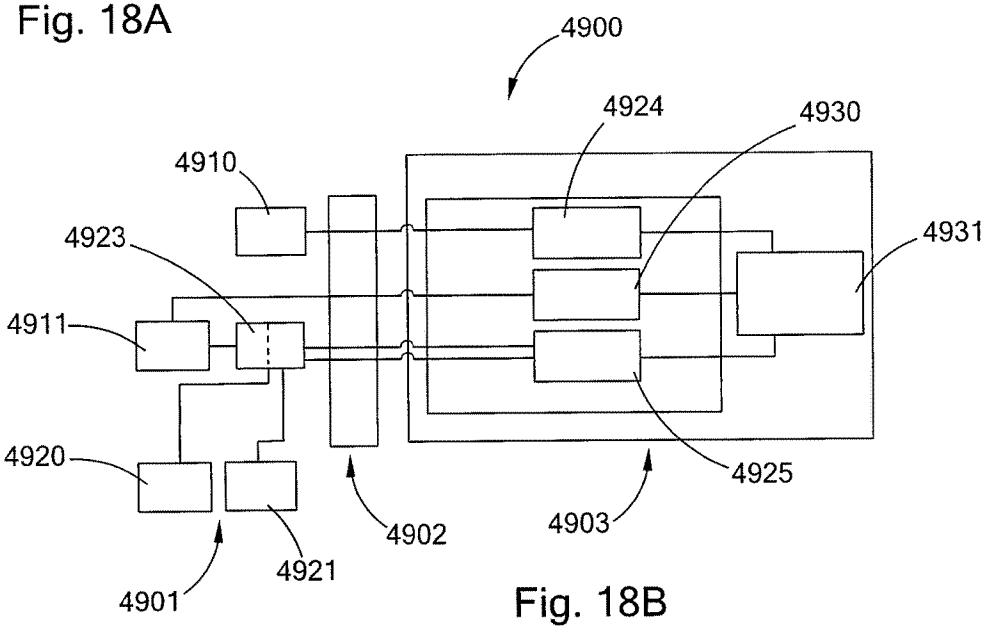
FIG. 18B is schematic view of an embodiment of a laser perforating tool in accordance with the present inventions.

FIGS. 17A and 18B show schematic layouts for perforating and cutting systems using a two fluid dual annular laser jet. Thus, there is an uphole section 4801 of the system 4800 that is located above the surface of the earth, or outside of the borehole. There is a conveyance section 4802, which operably associates the uphole section 4801 with the downhole section 4803. The uphole section has a high power laser unit 4810 and a power supply 4811. In this embodiment the conveyance section 4802 is a tube, a bunched cable, or umbilical having two fluid lines and a high power optical fiber. In the embodiment of FIG. 17A the downhole section has a first fluid source 4820, e.g., water or a mixture of oils having a predetermined index of refraction, and a second fluid source 4821, e.g., an oil having a predetermined and different index of refraction from the first fluid. The fluids are feed into a dual reservoir 4822 (the fluids are not mixed and are kept separate as indicated by the dashed line), which may be pressurized and which feeds dual pumps 4823 (the fluids are not mixed and are kept separate as indicated by the dashed line). In operation the two fluids 4820, 4821 are pumped to the dual fluid jet nozzle 4826. The high power laser beam, along a beam path enters the optics 4824, is shaped to a predetermined profile, and delivered into the nozzle 4826. In the embodiment of FIG. 17B a control head motor 4830 has been added and controlled motion laser jet 4831 has been employed in place of the laser jet 4826. Additionally, the reservoir 4822 may not used, as shown in the embodiment of FIG. 17B.

Turning to FIGS. 18A and 18B there is shown schematic layouts for cutting and perforating systems using a two fluid dual annular laser jet. Thus, there is an uphole section 4901 of the system 4900 that is located above the surface of the earth, or outside of the borehole. There is a conveyance section 4902, which operably associates the uphole section 4901 with the downhole section 4903. The uphole section has a high power laser unit 4910 and a power supply 4911 and has a first fluid source 4920, e.g., a gas or liquid, and a second fluid source 4921, e.g., a liquid having a predetermined index of refraction. The fluids are fed into a dual reservoir 4922 (the fluids are not mixed and are kept separate as indicated by the dashed line), which may be pressurized and which feeds dual pumps 4923 (the fluids are not mixed and are kept separate as indicated by the dashed line). In operation the two fluids 4920, 4921 are pumped through the conveyance section 4902 to the downhole section 4903 and into the dual fluid jet nozzle 4926. In this embodiment the conveyance section 4902 is a tube, a bunched cable, or umbilical. For FIG. 18A the conveyance section 4902 would have two fluid lines and a high power optical fiber In the embodiment of FIG. 18B the conveyance section 4902 would have two fluid lines, an electric line and a high power optical fiber. In the embodiment of FIG. 18A the downhole section has an optics assembly 4924 and a nozzle 4925. The high power laser beam, along a beam path enters the optics 4924, where it may be shaped to a predetermined profile, and delivered into the nozzle 4926. In the embodiment of FIG. 18B a control head motor 4930 has been added and controlled motion laser jet 4931 has been employed in place of the laser jet 4926. Additionally, the reservoir 4922 may not used as shown in the embodiment of FIG. 18B.

Downhole tractors and other types of driving or motive devices may be used with the laser tools. These devices can be used to advance the laser tool to a specific location where a laser process, e.g., a laser cut is needed, or they can be used to move the tool, and thus the laser head and beam path to deliver a particular pattern to make a particular cut. It being understood that the arrangement and spacing of these components in the tool may be changed, and that additional and different components may be used or substituted in, for example, such as a MWD/LWD section.

The high power laser fluid jets, laser heads and laser delivery assemblies disclosed and taught in US Patent Application Publ. No. 2012/0074110, the entire disclosure of which is incorporated herein by reference, may be used with, in, for, and as a part of the laser perforating tools and methods of the present inventions.

Laser fluid jets, and their laser tools and systems may provide for the creation of perforations in the borehole that can further be part of, or used in conjunction with, recovery activities such as geothermal wells, EGS (enhanced geothermal system, or engineered geothermal system), hydraulic fracturing, micro-fracturing, recovery of hydrocarbons from shale formations, oriented perforation, oriented fracturing and predetermined perforation patterns. Moreover, the present inventions provide the ability to have precise, varied and predetermined shapes for perforations, and to do so volumetrically, in all dimensions, i.e. length, width, depth and angle with respect to the borehole.

Thus, the present inventions provide for greater flexibility in determining the shape and location of perforations, than the conical perforation shapes that are typically formed by explosives. For example, perforations in the geometric shape of slots, squares, rectangles, ellipse, and polygons that do not diminish in area as the perforation extend into the formation, that expand in area as the perforation extends into the formation, or that decrease in area, e.g., taper, as the perforation extends into the formation are envisioned with the present inventions. Further, the locations of the perforation along the borehole can be adjusted and varied while the laser tool is downhole; and, as logging, formation, flow, pressure and measuring data is received. Thus, the present inventions provide for the ability to precisely position additional perforations without the need to remove the perforation tool from the borehole.

Accordingly, there is provided a procedure where a downhole tool having associated with it a logging and/or measuring tool and a fluid laser jet tool is inserting into a borehole. The laser tool is located in a desired position in the borehole (based upon real-time data, based upon data previously obtained, or a combination of both types of data) and a first predetermined pattern of perforations is created in that location. After the creation of this first set of perforations additional data from the borehole is obtained, without the removal of the laser tool, and based upon such additional data, a second pattern for additional perforations is determined (different shapes or particular shapes may also be determined) and those perforations are made, again without removal of the laser tool from the well. This process can be repeated until the desired flow, or other characteristics of the borehole are achieved.

Thus, by way of example and generally, in an illustrative hydro-fracturing operation water, proppants, e.g., sand, and additives are pumped at very high pressures down the borehole. These liquids flow through perforated sections of the borehole, and into the surrounding formation, fracturing the rock and injecting the proppants into the cracks, to keep the crack from collapsing and thus, the proppants, as their name implies, hold the cracks open. During this process operators monitor and gauge pressures, fluids and proppants, studying how they react with and within the borehole and surrounding formations. Based upon this data the typically the density of sand to water is increased as the frac progresses. This process may be repeated multiple times, in cycles or stages, to reach maximum areas of the wellbore. When this is done, the wellbore is temporarily plugged between each cycle to maintain the highest water pressure possible and get maximum fracturing results in the rock. These so called frac-plugs are drilled or removed from the wellbore and the well is tested for results. When the desired results have been obtained the water pressure is reduced and fluids are returned up the wellbore for disposal or treatment and re-use, leaving the sand in place to prop open the cracks and allow the hydrocarbons to flow. Further, such hydraulic fracturing can be used to increase, or provide the required, flow of hot fluids for use in geothermal wells, and by way of example, specifically for the creation of enhanced (or engineered) geothermal systems ("EGS").

The present invention provides the ability to greatly improve upon the typical fracing process, described above. Thus, with the present invention, preferably before the pumping of the fracing components begins, a very precise and predetermined perforating pattern can be placed in the borehole. For example, the shape, size, location and direction of each individual perforation can be predetermined and optimized for a particular formation and borehole. The direction of the individual perforation can be predetermined to coincide with, complement, or maximize existing fractures in the formation. Thus, although is it is preferred that the perforations are made prior the introduction of the fracing components, these steps maybe done at the same time, partially overlapping, or in any other sequence that the present inventions make possible. Moreover, this optimization can take place in real-time, without having to remove the laser tool of the present invention form the borehole. Additionally, at any cycle in the fracturing process the laser tool can be used to further maximize the location and shape of any additional perforations that may be desirable. The laser tool may also be utilized to remove the frac-plugs.

Figure 19:
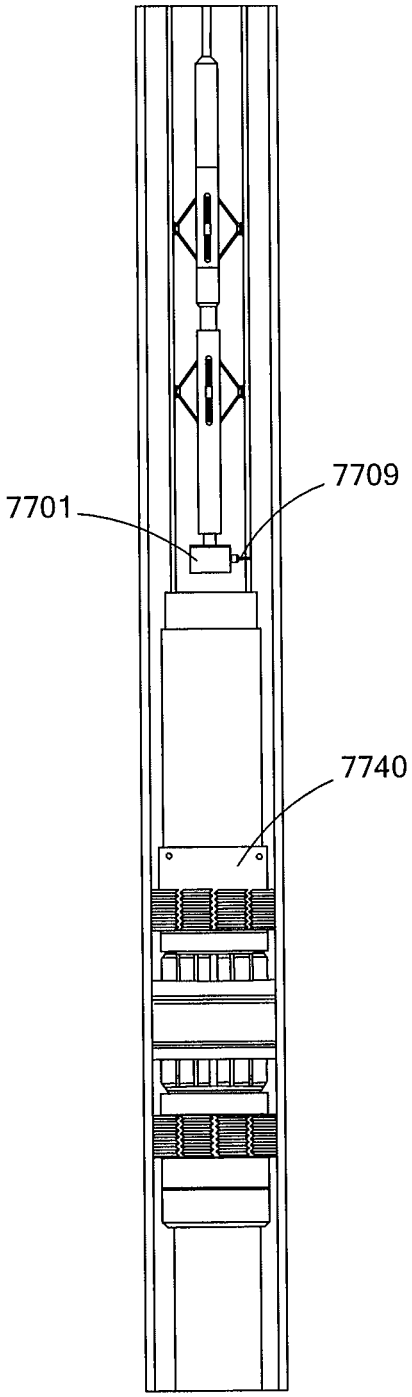
FIG. 19 is schematic view of an embodiment of a laser perforating tool in accordance with the present inventions.
Figure 20:
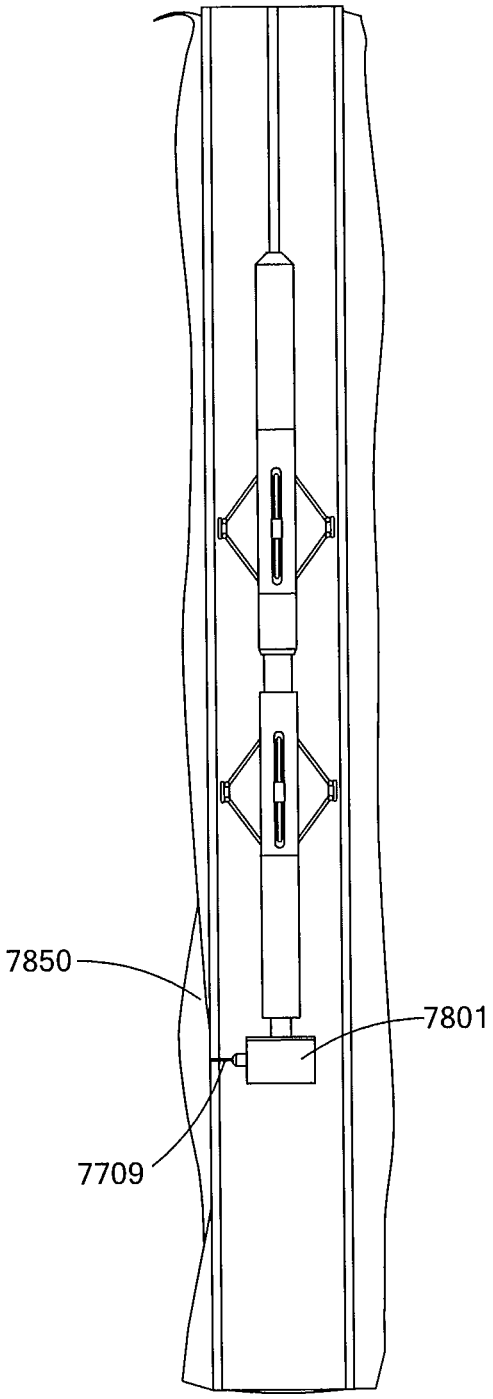
FIG. 20 is schematic view of an embodiment of a laser perforating tool in accordance with the present inventions.
Figure 21:
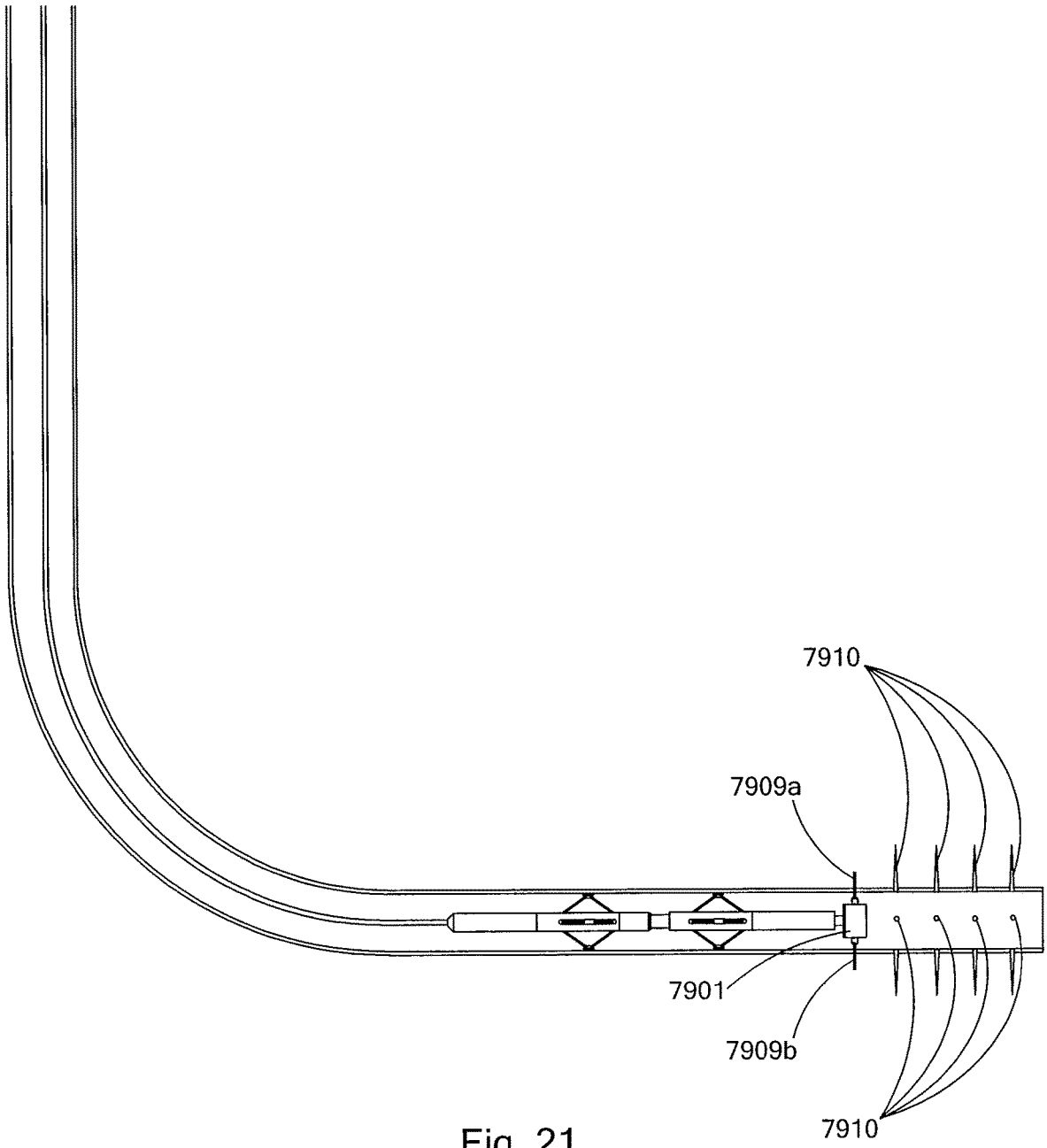
FIG. 21 is schematic view of an embodiment of a laser perforating tool in accordance with the present inventions.

Applications for perforating of tubing and casing with embodiments of laser tools, systems, methods and devices are shown in FIGS. 19, 20 and 21. The perforating of casing and tubing is done as a means of establishing communication between two areas previously isolated. The most common type of perforating done is for well production, the exposure of the producing zone to the drilled wellbore to allow product to enter the wellbore and be transported to surface facilities. Similar perforations are done for injection wells, providing communication to allow fluids and or gases to be injected at surface and placed into formation. Workover operations often require perforating to allow the precise placement of cement behind casing to ensure adequate bond/seal or the establishing of circulation between two areas previously sealed due to mechanical failure within the system.

These perforations are typically done with explosive charges and projectiles, deployed by either electric line/wireline or by tubing, either coiled or jointed. The charges can be set fired by electric signal or by pressure activated mechanical means.

Using the laser system many, if not all, of the disadvantages of the existing non-laser procedures may be reduced, substantially reduced or eliminated. The laser system for perforating includes a laser cutting head 7701, 7801, 7901, which propagates a laser beam(s) 7709, 7809, 7909*a* and 7909*b*, an anchoring or an anchoring/tractor device, 7704, 7804, 7904 an imaging tool and a direction/inclination/orientation measurement tool. The assembly is conveyed with a wireline style unit and a hybrid electric line. The assembly is capable of running in to a well and perforating multiple times through the wellbore in a single trip, with the perforations 7910 specifically placed in distance, size, frequency, depth, and orientation. The tool is also capable of cutting slots in the pipe to maximize exposure while minimizing solids production from a less-than-consolidated formation. In a horizontal wellbore, the tractor 7904 is engaged to move the assembly while perforating. The tool is capable of perforating while underbalanced, even while the well is producing, allowing evaluation of specific zones to be done as the perforating is conducted. The tool is relatively short, allowing deployment method significantly easier than traditional underbalanced perforating systems. In FIG. 19 the tool is positioned above a packer 7740 to establish an area to be perforated that has an established circulation, in FIG. 78 the tool is being used to cut access to an area of poor cement bond 7850.

For single shot applications, there is no need for explosive permitting and the associated safety measures required on a job location, with the system having the ability to run in the well and precisely place a hole of desired dimension, without risk of damage to other components within the wellbore safely and quickly.

An example of another application for the present laser tools, systems, methods and devices is a to provide a new subsurface method of geothermal heat recovery from existing wells situated in permeable sedimentary formations. This laser based method minimizes water consumption and may also eliminate or reduces the need for hydraulic fracturing by deploying the present laser tools to cut long slots extending along the length (top to bottom) of the well and thus providing greatly increased and essentially maximum contact with the heat resource in preferably a single down hole operation.

The existing well infrastructure system in the United States includes millions of abandoned wells in sedimentary formations, many at temperatures high enough to support geothermal production. These existing wells were originally completed to either minimize water flow or bypass water-bearing zones, and would need to be converted (i.e. re-completed) to support geothermal heat recovery. Such wells may be re-completed and thus converted into a geothermal well using the present laser cutting tools. The slots that these laser tools can cut increases geothermal fluid flow by increasing wellbore-to-formation surface area. The present laser tools may rapidly create long vertical slots (hundreds to thousands of feet long) in the casing, cement and formation in existing wells in a single downhole operation (by contrast, perforation requires many trips due to the consumptive use of explosives). These long laser created slots can cover the entire water-bearing zone of the well, and thus, maximize water flow rates and heat recovery. In turn, the need for acidizing and hydraulic fracturing may also be reduced or eliminated, further decreasing costs. The long laser cut slots provide several benefits, including: higher flow rates; increases in the wellbore/formation surface area; reduction in the risk of missing high-permeability sections of the formation due to perforation spacing; and, eliminating or reducing the crushed zone effect that is present with explosive perforations.

Figure 22:
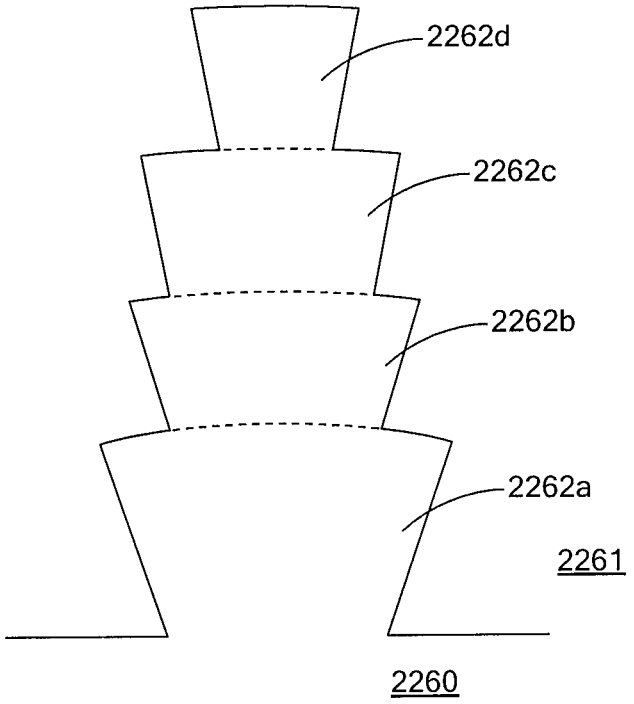
FIG. 22 is schematic view of an embodiment of a laser energy delivery pattern in accordance with the present inventions.

FIG. 22 shows a stepping down fan perforating pattern that can be implemented with the present laser perforation tools. In this pattern a series of progressively smaller fan shapes 2262*a*, 2262*b*, 2262*c*, 2262*d* are cut into formation 2261 moving away from borehole 2260. The dashed lines indicated the end of a first fan pattern that was cut through with the deeper, and later in time, fan pattern.

Figure 23A:
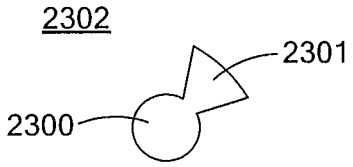
FIGS. 23A and 23B are plan and perspective views respectively of an embodiment of a laser energy delivery pattern in accordance with the present inventions.
Figure 23B:
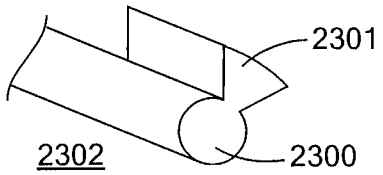

FIG. 23A is a plan view looking down borehole 2300 showing fan, or pie shape perforation 2301 in formation 2302. FIG. 23B is a perspective view along the longitudinal axis of borehole 2300 showing that pie shape perforation 2301 is a volumetric shape extending along the borehole 2300. The length of pie shaped perforation 2301 may be a few inches to a few feet, tens of feet or more. Additionally more than one pie shaped perforation can be space along the length of the borehole.

Figure 24A:
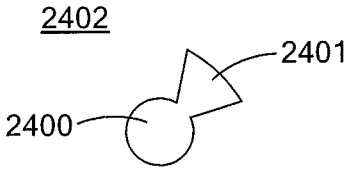
FIGS. 24A and 24B are plan and perspective views respectively of an embodiment of a laser energy delivery pattern in accordance with the present inventions.
Figure 24B:
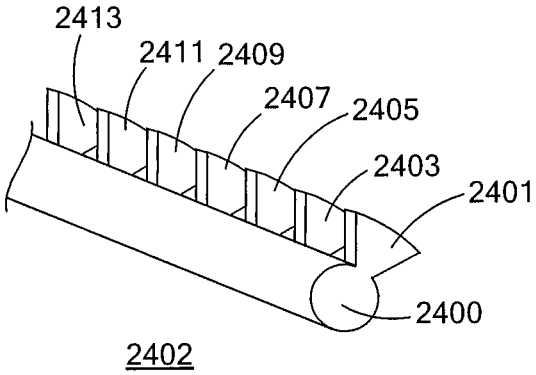

FIG. 24A is a plan view looking down borehole 2400 showing fan, or pie shape perforation 2401 in formation 2402. FIG. 24B is a perspective view along the longitudinal axis of borehole 2400 showing that there are a number of pie shape perforation 2401, 2403, 2405, 2407, 2409, 2411, 2413 spaced along the length of the borehole 2401 and that each is a volumetric shape extending along the length of the borehole 2400. The length of pie shaped perforation 2401, 2403, 2405, 2407, 2409, 2411, 2413, may be a few inches to a few feet, tens of feet or more. Their lengths, and their spacing may be uniform, or it may be staged to, for example, match to formation characteristics to optimize fluid communication between the borehole and the formation.

Figure 25A:
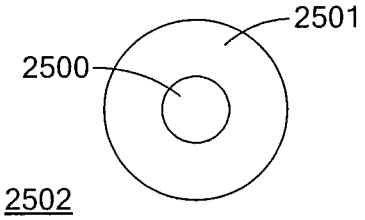
FIGS. 25A and 25B are plan and perspective views respectively of an embodiment of a laser energy delivery pattern in accordance with the present inventions.
Figure 25B:
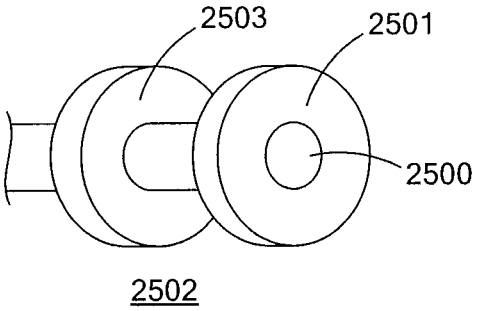

FIG. 25A is a plan view looking down borehole 2500 showing a disk shaped perforation 2501 in formation 2502. FIG. 25B is a perspective view along the longitudinal axis of borehole 2500 showing that there are a number of disk shape perforation 2501, 2503, spaced along the length of the borehole 2501 and that each is a volumetric shape extending along the length of the borehole 2500. The length of disk shaped perforation 2501, 2503 may be an inch, few inches to a few feet, but should not be so long as to adversely effect the stability of the well bore. Their lengths, and their spacing may be uniform, or it may be staged to, for example, match to formation characteristics to optimize fluid communication between the borehole and the formation.

Figure 26B:
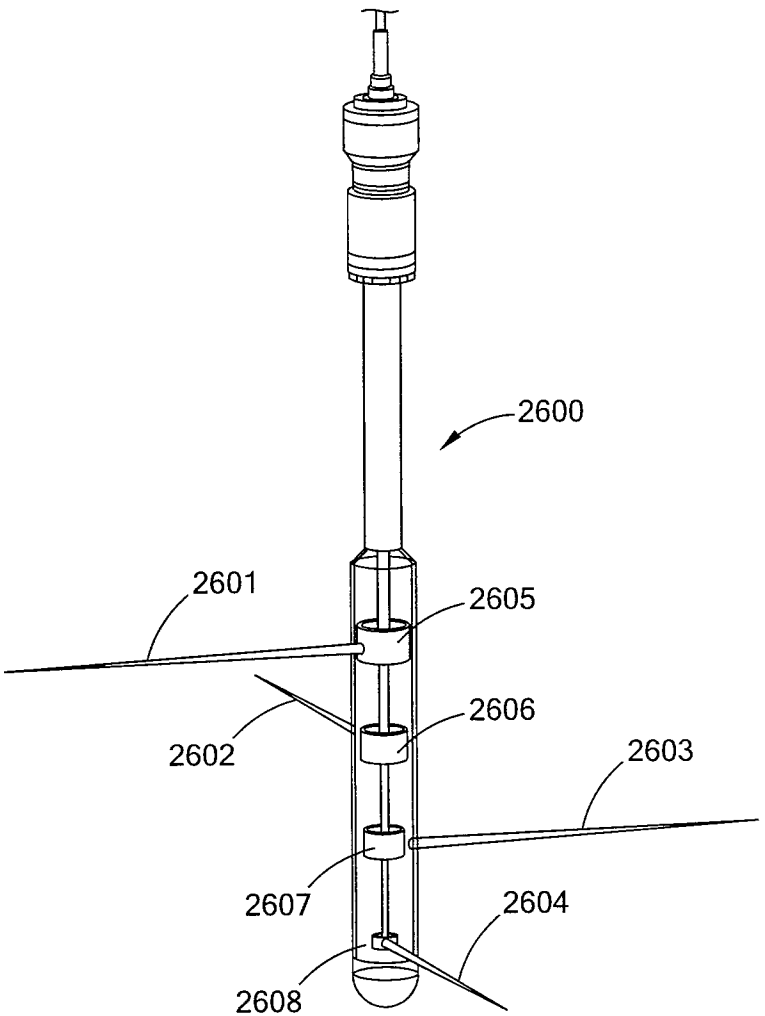
FIG. 26B is a cutaway perspective view of the embodiment of FIG. 26A.
Figure 26A:
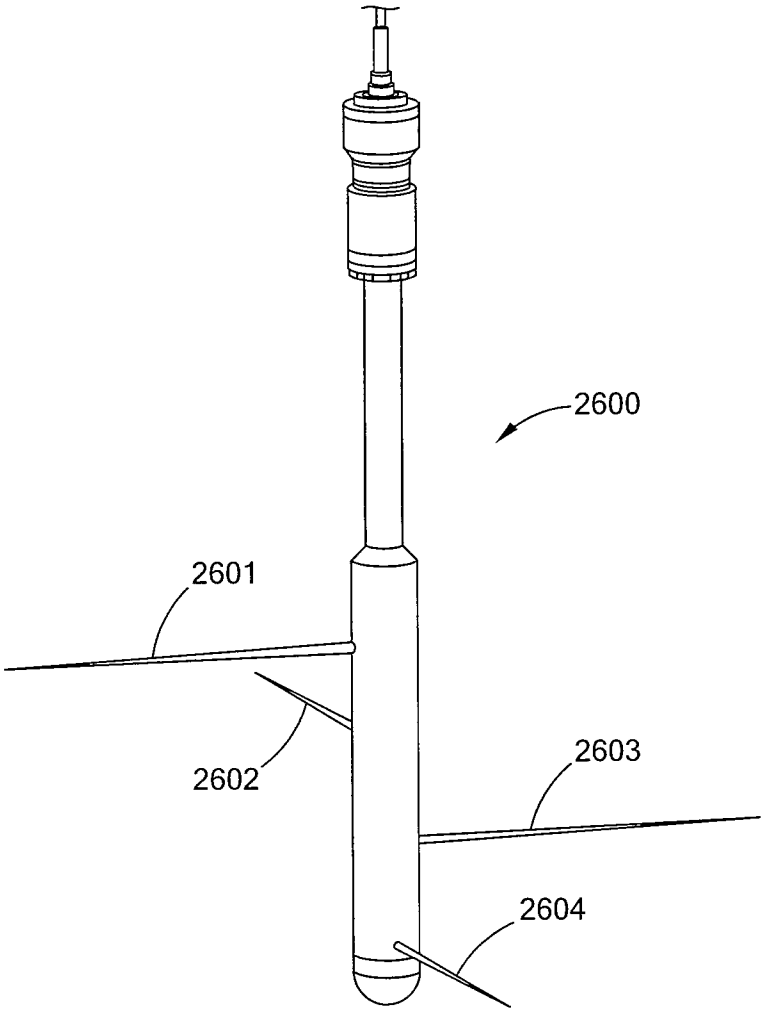
FIG. 26A is a perspective view of an embodiment of a laser perforating tool in accordance with the present inventions.
Figure 26C:
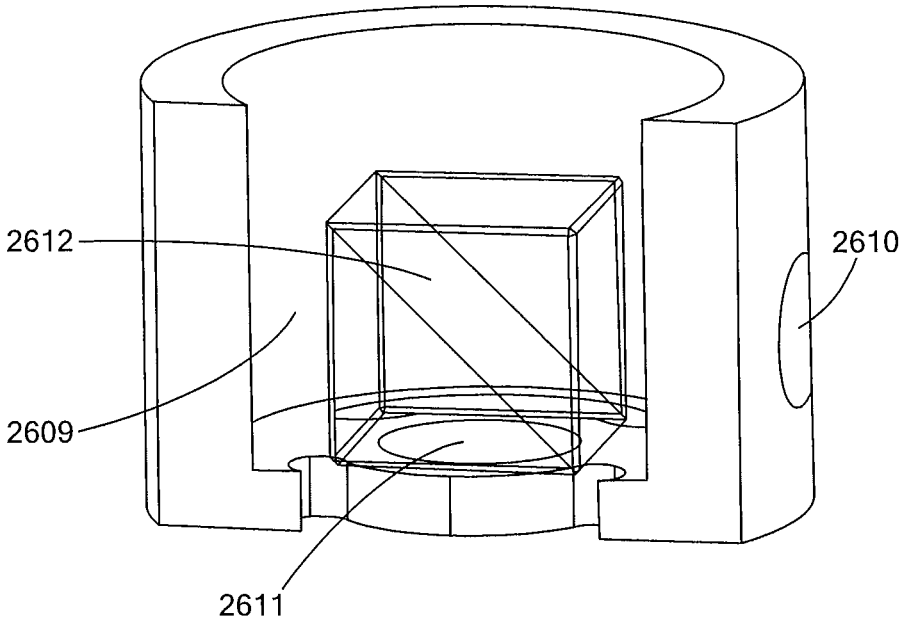
FIG. 26C is a cutaway perspective view of a component of the embodiment of FIG. 26A.

Turning to FIG. 26A there is provided a perspective view of an embodiment of a laser perforating tool 2600 having four laser beam delivery assemblies 2605, 2606, 2607, 2608, which deliver four laser beams 2601, 2602, 2603, 2604 to form perforations in the borehole side wall and formation. Laser beam delivery assemblies, 2605, 2606, 2607 each have a beam splitter, e.g., 2612, in a housing which has air cooling passage 2609, and laser path openings 2610, 2611. The bottom laser delivery assembly has a TIR prism for directing laser beam 2604.

The laser perforating tools may also find applications in activities such as: off-shore activities; subsea activities; decommissioning structures such as, oil rigs, oil platforms, offshore platforms, factories, nuclear facilities, nuclear reactors, pipelines, bridges, etc.; cutting and removal of structures in refineries; civil engineering projects and construction and demolitions; concrete repair and removal; mining; surface mining; deep mining; rock and earth removal; surface mining; tunneling; making small diameter bores; oil field perforating; oil field fracking; well completion; window cutting; well decommissioning; well workover; precise and from a distance in-place milling and machining; heat treating; drilling and advancing boreholes; workover and completion; flow assurance; and, combinations and variations of these and other activities and operations.

A single high power laser may be utilized in or with these system, tools and operations, or there may be two or three high power lasers, or more. High power solid-state lasers, specifically semiconductor lasers and fiber lasers are preferred, because of their short start up time and essentially instant-on capabilities. The high power lasers for example may be fiber lasers, disk lasers or semiconductor lasers having 5 kW, 10 kW, 20 kW, 50 kW, 80 kW or more power and, which emit laser beams with wavelengths in the range from about 455 nm (nanometers) to about 2100 nm, preferably in the range about 400 nm to about 1600 nm, about 400 nm to about 800 nm, 800 nm to about 1600 nm, about 1060 nm to 1080 nm, 1530 nm to 1600 nm, 1800 nm to 2100 nm, and more preferably about 1064 nm, about 1070-1080 nm, about 1360 nm, about 1455 nm, 1490 nm, or about 1550 nm, or about 1900 nm (wavelengths in the range of 1900 nm may be provided by Thulium lasers). An example of this general type of fiber laser is the IPG YLS-20000. The detailed properties of which are disclosed in US patent application Publication Number 2010/0044106. Thus, by way of example, there is contemplated the use of four, five, or six, 20 kW lasers to provide a laser beam having a power greater than about 60 kW, greater than about 70 kW, greater than about 80 kW, greater than about 90 kW and greater than about 100 kW. One laser may also be envisioned to provide these higher laser powers.

The various embodiments of high power laser perforating tools set forth in this specification may be used with various high power laser systems and conveyance structures and systems, in addition to those embodiments of the figures and embodiments in this specification. For example, embodiments of a laser perforating tool may use, or be used in, or with, the systems, lasers, tools and methods disclosed and taught in the following US patent applications and patent application publications: Publication No. 2010/0044106; Publication No. 2010/0215326; Publication No. 2012/0275159; Publication No. 2010/0044103; Publication No. 2012/0267168; Publication No. 2012/0020631; Publication No. 2013/0011102; Publication No. 2012/0217018; Publication No. 2012/0217015; Publication No. 2012/0255933; Publication No. 2012/0074110; Publication No. 2012/0068086; Publication No. 2012/0273470; Publication No. 2012/0067643; Publication No. 2012/0266803; Ser. No. 13/868,149; Ser. No. 61/745,661; and Ser. No. 61/727,096, the entire disclosure of each of which are incorporated herein by reference.

The inventions may be embodied in other forms than those specifically disclosed herein without departing from its spirit or essential characteristics. The described embodiments are to be considered in all respects only as illustrative and not restrictive.

What is claimed:

1. A method of enhancing fluid communication between a borehole and a formation in the earth, the method comprising:

a. positioning a high power laser tool in a predetermined location within a borehole in a formation;

b. the laser tool in optical communication with a source of a high power laser beam, wherein the laser beam has a power from 10 to 40 kW;

c. delivering the high power laser beam in a predetermined laser beam delivery pattern to the formation; wherein, the laser beam delivery pattern comprises a plurality of laser beam perforation patterns;

d. wherein the location and shape of the laser beam perforation patterns is based at least in part on geological properties of the formation; and, e. whereby the laser beam delivery pattern creates a custom geometry in the formation enhancing fluid communication between the borehole and the formation.

2. The method of claim 1, wherein the laser tool comprises an optics package having a compound optics system; the compound optics systems comprising a main body, an adjustment body and a fixed ring.

3. The method of claim 1, wherein the compound optics system can be adjusted to a focal length of 1,000 mm.

4. The method of claim 1, wherein the custom geometry in the formation comprises longitudinal slots.

5. The method of claim 1, wherein the custom geometry in the formation comprises pie shapes.

6. The method of claim 1, wherein the custom geometry in the formation comprises a plurality of pie shapes spaced along the length of the borehole.

7. The method of claim 1, wherein the custom geometry in the formation comprises a longitudinal slot in a pie shape.

8. The method of claim 1, wherein the custom geometry in the formation comprises a disk shape.

9. The method of claim 1, wherein the custom geometry in the formation comprises laser induced fracturing.

10. A well, wherein the well is made by the method comprising:

a. obtaining data about the geological properties of the formation containing the hydrocarbon reservoir;

b. obtaining a hydraulic fracturing plan for the formation;

c. inserting a high power laser tool into a borehole, and advancing the laser tool to a predetermined location within the borehole;

d. placing the laser tool in optical and control communication with a high power laser delivery system;

e. based, at least in part, on the formation data and the hydraulic fracturing plan, determining a laser energy delivery pattern; wherein, the laser energy delivery pattern comprises a plurality of laser perforations for predetermined locations in the formation;

f. the laser delivery system and laser tool delivering the laser energy delivery pattern to the predetermined location within the borehole; and, g. hydraulic fracturing the formation based, at least in part, upon the hydraulic fracturing plan;

h. whereby, the laser energy creates the custom geometry in the formation enhancing the hydraulic fracturing of the formation and thereby, enhancing the fluid communication between the borehole and the hydrocarbon reservoir in the formation.

11. A well, wherein the well is made by the method comprising:

a. positioning a high power laser tool in a predetermined location within the borehole in the formation;

b. the laser tool in optical communication with a source of a high power laser beam, wherein the laser beam has a power from 10 to 40 kW;

c. delivering the high power laser beam in a predetermined laser beam delivery pattern to the formation; wherein, the laser beam delivery pattern comprises a plurality of laser beam perforation patterns;

d. wherein the location and shape of the laser beam perforation patterns is based at least in part on geological properties of the formation; and, e. whereby the laser beam delivery pattern creates the custom geometry in the formation enhancing fluid communication between the borehole and the formation.

* * * * *